US008671860B2

(12) United States Patent
Kawaguchi et al.

(10) Patent No.: US 8,671,860 B2
(45) **Date of Patent: *Mar. 18, 2014**

(54) PUNCH DATA GENERATING DEVICE AND COMPUTER READABLE MEDIUM STORING PUNCH DATA GENERATING PROGRAM

(75) Inventors: Yasuhiko Kawaguchi, Nagoya (JP); Yukiyoshi Muto, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 741 days.

This patent is subject to a terminal disclaimer.

(21) Appl. No.: 12/902,662

(22) Filed: Oct. 12, 2010

(65) Prior Publication Data

US 2011/0088606 A1 Apr. 21, 2011

(30) Foreign Application Priority Data

Oct. 21, 2009 (JP) ..... 2009-242358

(51) Int. Cl.
*D05B 1/00* (2006.01)

(52) U.S. Cl.
USPC ..... 112/475.05

(58) Field of Classification Search
USPC ..... 112/102.5, 73, 78, 155, 221, 222, 112/470.05, 470.06, 475.05, 475.18, 112/475.19; 72/379.2, 446, 455, 464
See application file for complete search history.

(56) References Cited

U.S. PATENT DOCUMENTS 5,390,126 A * 2/1995 Kongho et al. ..... 700/138
5,810,526 A * 9/1998 Hirai ..... 409/131
5,915,316 A * 6/1999 Tajima et al. ..... 112/470.05

FOREIGN PATENT DOCUMENTS

JP A-05-096071 4/1993
JP A-07-237183 9/1995
JP A-11-172566 6/1999

* cited by examiner

*Primary Examiner* — Tejash Patel
(74) *Attorney, Agent, or Firm* — Oliff PLC

(57) ABSTRACT

A punch data generating device generating punch data for execution with an embroiderable sewing machine including a needle bar that is moved up and down and mounted with a punch needle for forming penetrations on a workpiece in dot-by-dot strokes, a transfer mechanism transferring the workpiece in two directions in coordination with the movement of the punch needle to form the penetrations. The punch data generating device includes a punch data generator generating punch data, the punch data including at least either of draw data being configured to instruct sequential formation of the penetrations to draw a predetermined pattern, and cut data being configured to instruct sequential formation of the penetrations along an outline of a predetermined pattern to allow cutting of the outline; and a data modifier modifying at least either of the draw data and the cut data to change how the penetrations are to be formed.

12 Claims, 21 Drawing Sheets

| LINE NO. | PUNCH TYPE | LINE ELEMENTS |
|---|---|---|
| 1 | CUT | P0,P1,P2,P3,P4,P5,P6,P7 |
| 2 | DRAW | P0,P7 |
| 3 | CUT | P7,P8,P9,P10,P11,P12 |
| 4 | CUT | P12,P13,P14,P15,P16,P17,P18,P19 |
| 5 | DRAW | P12,P19 |
| 6 | CUT | P19,P0 |
| 7 | DRAW | P20,P21,P22,P23,P24,P25,P20 |
| 8 | DRAW | P26,P27,P28,P29,P30,P31,P26 |
| 9 | DRAW | P32,P33,P34,P32 |
| 10 | DRAW | P35,P36,P37,P38 |

FIG. 8A

| LINE NO. | PUNCH TYPE | LINE ELEMENTS |
|---|---|---|
| 1 | DRAW | P0,P7 |
| 2 | DRAW | P12,P19 |
| 3 | DRAW | P20,P21,P22,P23,P24,P25,P20 |
| 4 | DRAW | P26,P27,P28,P29,P30,P31,P26 |
| 5 | DRAW | P32,P33,P34,P32 |
| 6 | DRAW | P35,P36,P37,P38 |
| 7 | CUT | P0,P1,P2,P3,P4,P5,P6,P7,P8,P9,P10,P11,P12,<br>P13,P14,P15,P16,P17,P18,P19,P0 |

FIG.8B

PUNCH DATA GENERATING DEVICE AND COMPUTER READABLE MEDIUM STORING PUNCH DATA GENERATING PROGRAM

CROSS-REFERENCE TO RELATED APPLICATION(S)

This application is based upon and claims the benefit of priority from the prior Japanese Patent Application 2009-242358 filed on Oct. 21, 2009, the entire content of which are incorporated herein by reference.

FIELD

The present disclosure relates to a punch data generating device that generates punch data for execution of a penetration forming operation by an embroiderable sewing machine to form penetrations on workpiece sheet. The present disclosure also relates to a computer readable medium storing a punch data generating program.

BACKGROUND

Conventional multi-needle embroidery sewing machines are capable of executing embroidery sewing operations with multiple thread colors. A typical multi-needle embroidery sewing machine of such type is provided with a sewing mechanism and a controller that controls the sewing mechanism. The sewing mechanism is configured, for instance, by a needle-bar case containing six needle bars, a needle-bar selection mechanism, and a needle-bar drive mechanism. The needle-bar selection mechanism selects a given needle by transferring the needle-bar case in the left and right direction and the selected needle bar is connected to the needle-bar drive mechanism to be driven up and down. The sewing mechanism is further configured by a transfer mechanism that transfers an embroidery frame holding a workpiece cloth in the X and Y directions. The controller, on the other hand, receives input of pattern data that contains instructions on the amount of stroke-by-stroke movement of workpiece cloth/embroidery frame, and on timing for changing the thread color, etc. Based on the pattern data, the controller transfers the embroidery frame holding the workpiece cloth in the X and Y directions by the transfer mechanism while controlling other components of the sewing mechanism to form embroidery in multiple colors.

Such multi-needle embroidery sewing machine has found a new application where decorations are created on the workpiece cloth by using a technique called needle punch. To elaborate, needle punches are formed on the workpiece cloth by attaching a needle punch needle on some of the needle bars in place of a sewing needle and driving the needle punch needle based on needle punch information.

Some embroidery sewing machines come with a heat cutter provided with a heater for creating patches of images and characters. Such heat cutters are attached to the carriage of a drive mechanism of an embroidery frame. The heat cutter cuts through fabric and paper to cut out the patches.

The inventors have conceived to utilize the multi-needle embroidery sewing machine as a device for creating patterns on a sheet of workpiece such as paper. One exemplary configuration for creating the patterns with the multi-needle sewing machine may be as follows. Some of the plurality of needle bars is mounted with one or more punch needle(s) for forming penetrations such as small holes instead of a sewing needle(s).

Further, embroidery frame for holding the workpiece being attached to the transfer mechanism may be replaced by a holder providing a secure hold of the workpiece which is also attached to the transfer mechanism. Thus, a desired pattern made of a plurality of penetrations such as small holes can be created on the surface of the workpiece cloth by moving the needle bar(s) having punch needle(s) attached to it up and down by the needle bar drive mechanism while transferring the holder holding the workpiece by the transfer mechanism.

After creating the pattern made of multiplicity of penetrations on workpiece such as paper with the above configured device, the user may desire to cut out the created pattern along the outline of the workpiece. In such case, it would be quite troublesome for the user to neatly cut out the pattern from the workpiece manually with scissors, etc. Thus, the aforementioned cutter may be attached to the sewing machine to cut out the workpiece in the desired shape. Another alternative may be to use a dedicated cutter known as a cutting plotter.

In either of the above alternative cases, a separate cutter or a cutter plotter need to be prepared as an attachment to the sewing machine, and thus, would lead to cost increase of the system. In drawing a pattern on a workpiece sheet based on the punch data through formation of multiplicity of penetrations, it would be further advantageous to prevent ripping of the workpiece sheet which may be caused by interconnection of penetrations that are formed close together. In forming a cut on the workpiece sheet along the outline of the intended pattern, it is desirable to prevent imperfect or premature cut to allow the workpiece sheet to be cut through completely.

SUMMARY

One object of the present disclosure is to provide a punch data generating device that generates punch data for forming penetrations on a sheet of workpiece with an embroiderable sewing machine to draw a predetermined pattern on the workpiece and or cut the workpiece along the outline of the pattern. In doing so, the patterns are drawn on the workpeice without any unintended rips and the patterns and cuts are made along the outline without leaving any uncut portions. It is another object of the present disclosure to provide a computer readable medium storing a punch data generating program to render the above described features.

In one aspect of the present disclosure there is provided a punch data generating device that generates punch data for execution with an embroiderable sewing machine including a needle bar allowing attachment of a punch needle for forming a plurality of penetrations on a sheet of workpiece by piercing the workpiece in dot-by-dot strokes of the punch needle, a transfer mechanism that transfers the workpiece in two predetermined directions in coordination with an up and down movement of the punch needle to execute a penetration forming operation for forming the penetrations on the workpiece. The punch data generating device includes a punch data generator that generates the punch data, the punch data including at least either of draw data being configured to instruct sequential formation of the penetrations to draw a predetermined pattern and cut data being configured to instruct sequential formation of the penetrations at least along an outline of the predetermined pattern to allow cutting of the outline; and a data modifier that modifies at least either of the draw data and the cut data to change how the penetrations are to be formed.

BRIEF DESCRIPTION OF THE DRAWINGS

Other objects, features and advantages of the present disclosure will become clear upon reviewing the following description of the illustrative aspects with reference to the accompanying drawings, in which.

FIG. 8A exemplifies a data configuration of line data in an unmodified state;

FIG. 8B exemplifies a data configuration of line data after integration of a cut-data based lines;

DETAILED DESCRIPTION

A description will be given hereinafter on a first exemplary embodiment of the present disclosure with reference to FIGS. 1 to 19B. The first exemplary embodiment describes a case where a multi-needle embroidery sewing machine capable of forming embroideries includes the features of a punch data generating device. The multi-needle embroidery sewing machine may also be referred to as embroidery sewing machine or embroiderable sewing machine. First, a description will be given on the configuration of multi-needle embroidery sewing machine 1. In the description given hereinafter, the left and right direction relative to multi-needle embroidery sewing machine 1, is defined as the X direction whereas the front and rear direction relative to multi-needle embroidery sewing machine 1 is defined as the Y direction as indicated in FIGS. 1 to 3.

Figure 1:
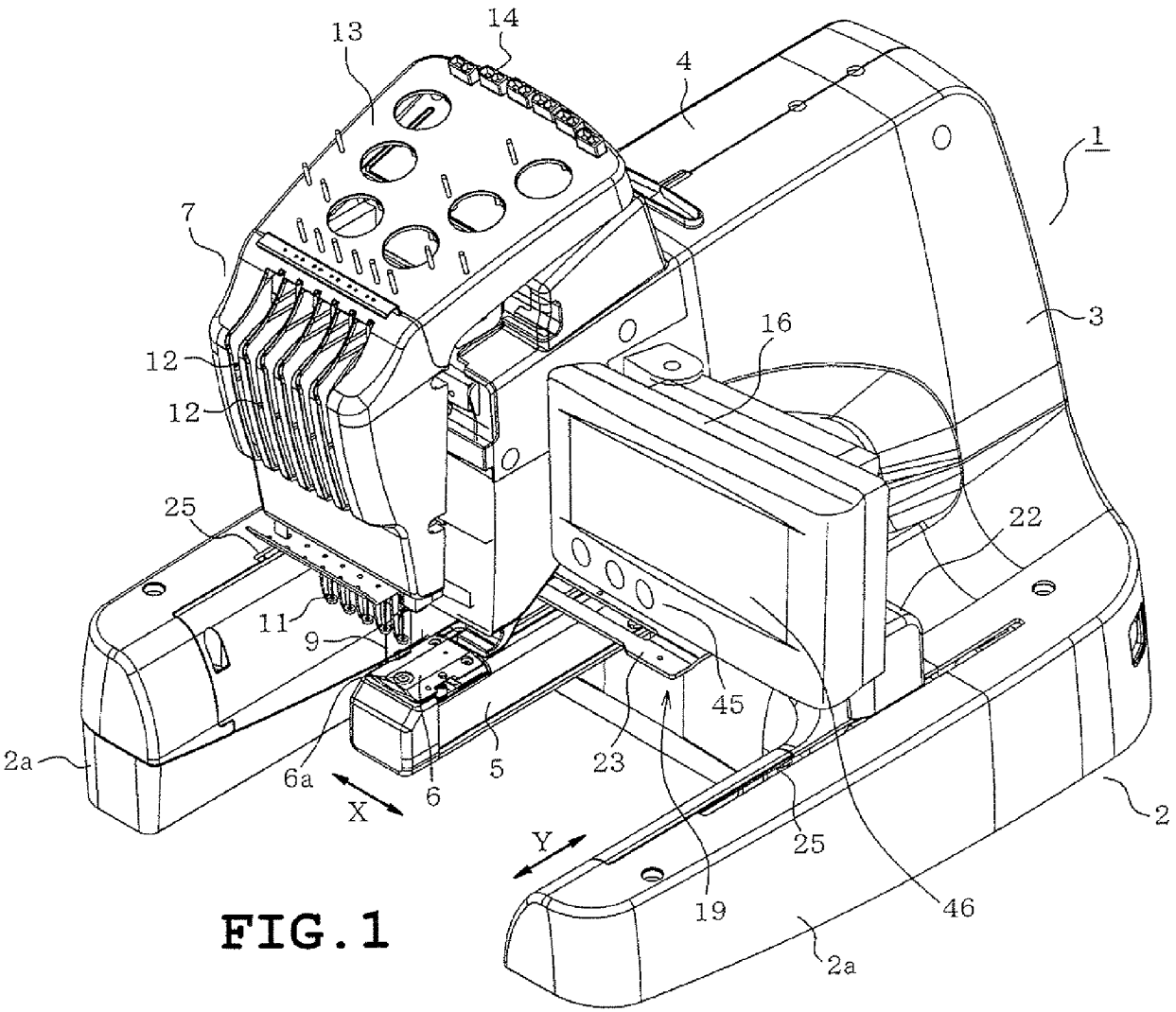
FIG. 1 is a general perspective view of a multi-needle embroidery sewing machine according to a first exemplary embodiment of the present disclosure.

Referring to FIG. 1, multi-needle embroidery sewing machine 1 is primarily configured by support base 2 placed on a placement base not shown, pillar 3 extending upward from the rear end of support base 2, and arm 4 extending forward from the upper end of pillar 3. Support base 2 is configured in U-shape in top view with left and right feet 2*a* extending forward to embrace a forward opening between them. Support base 2 is further provided integrally with cylinder bed 5 extending forward from its rearward mid portion. On the upper portion of the extremity of cylinder bed 5, needle plate 6 is provided that has needle holes 6*a* defined on it. Though not shown, cylinder bed 5 contains components such as a loop taker shuttle, a thread cut mechanism, and a picker.

Figure 6:
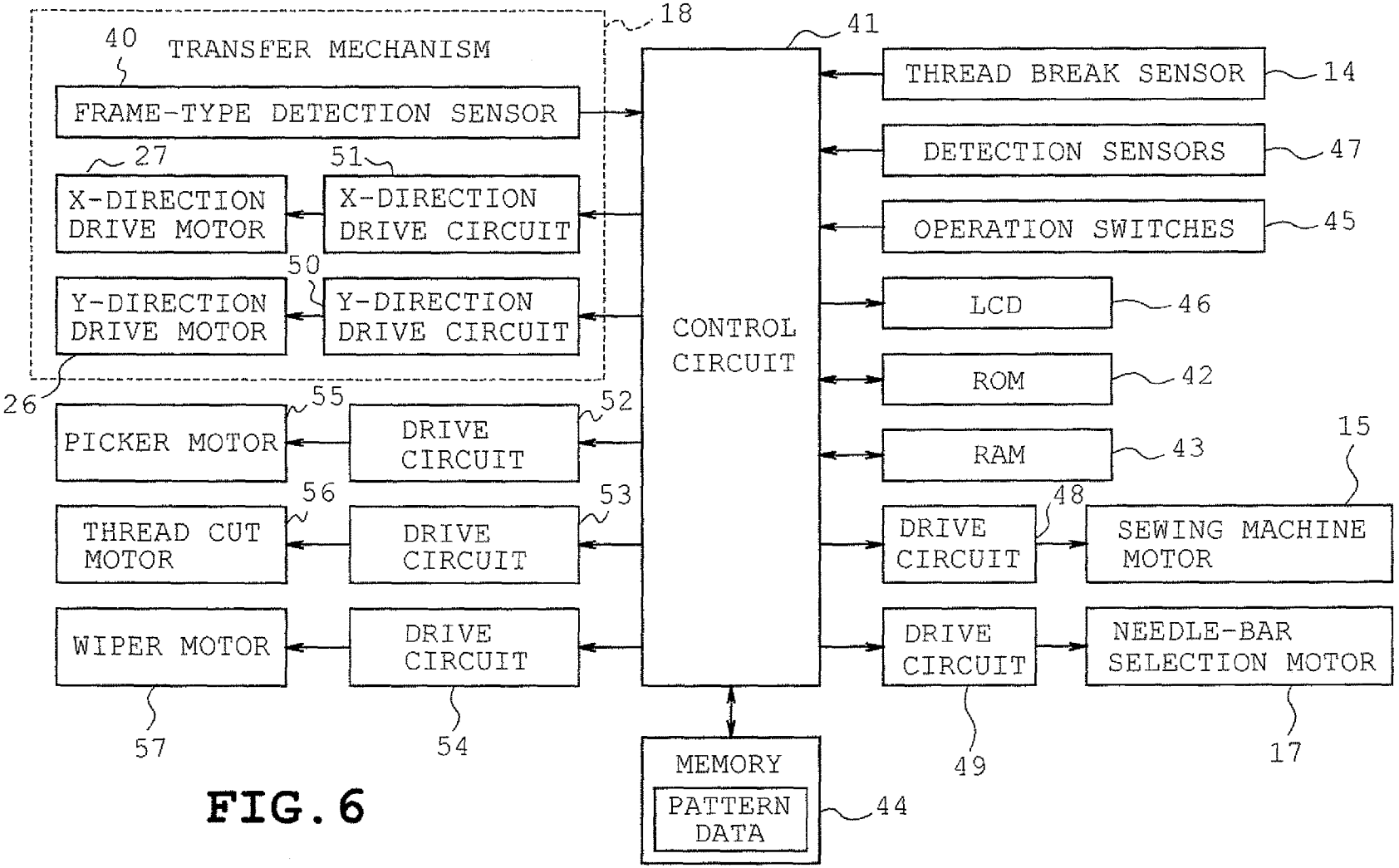
FIG. 6 is an overall block diagram of an electrical configuration of the multi-needle embroidery sewing machine.

On the right side of arm 4, control panel 16 is provided that is implemented with elements such as control switches 45 to allow the user to make various instructions, selections, and inputs and a liquid crystal display 46, simply represented as LCD 46 in FIG. 6, that displays various messages, etc. to be presented to the user. Control switches 45 include a plurality of mechanical switches not shown provided in the vicinity of LCD 46 and a touch panel implemented on the screen of LCD 46. As later described, LCD 46 displays images of patterns and outlines based on punch data. Though not shown, at the rear side upper portion of arm 4, a thread supplier capable of accommodating multiple thread spools is provided, which is configured to hold six thread spools in the present exemplary embodiment.

Figure 2:
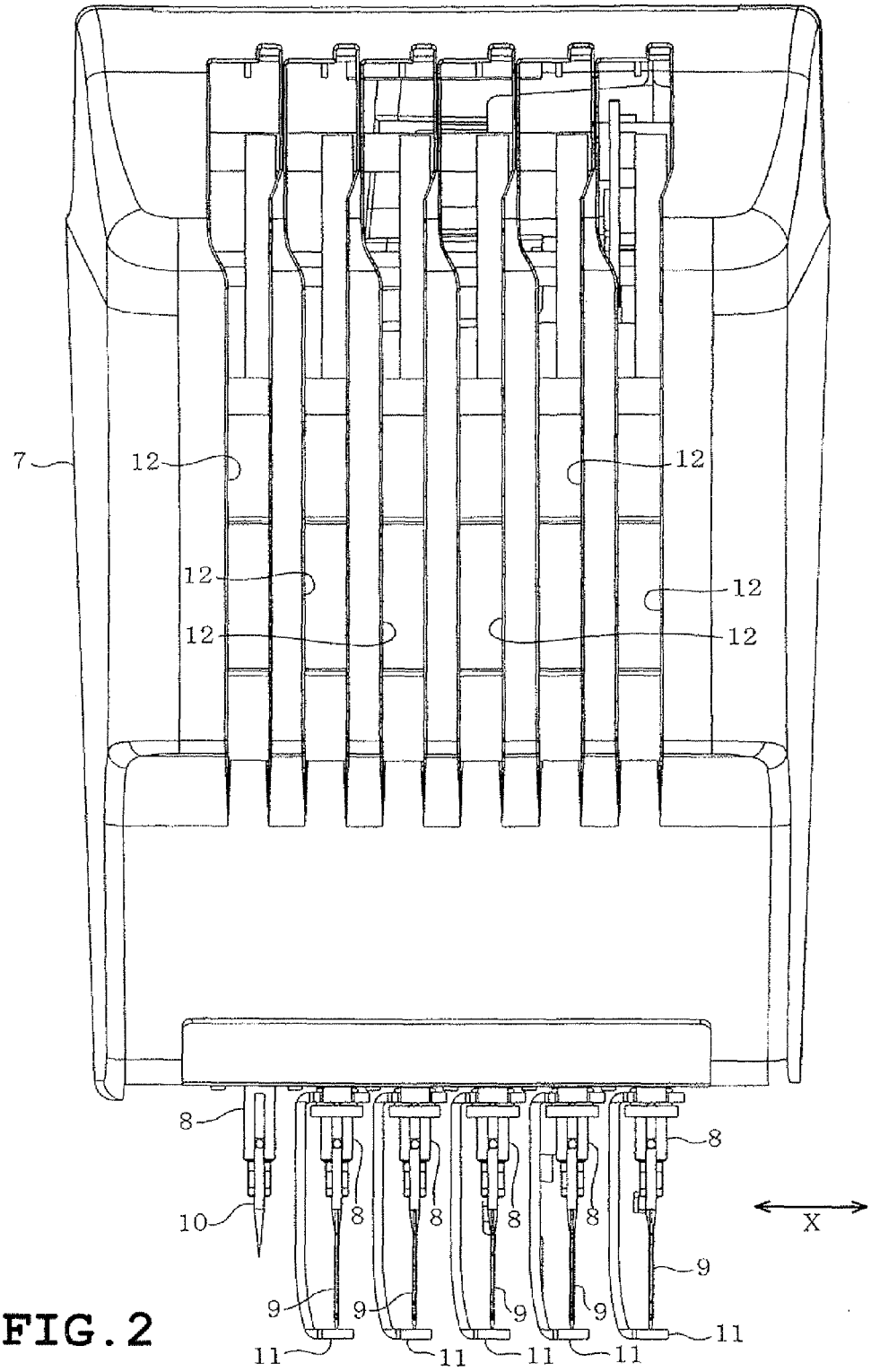
FIG. 2 is a front view of a needle bar case.
Figure 3:
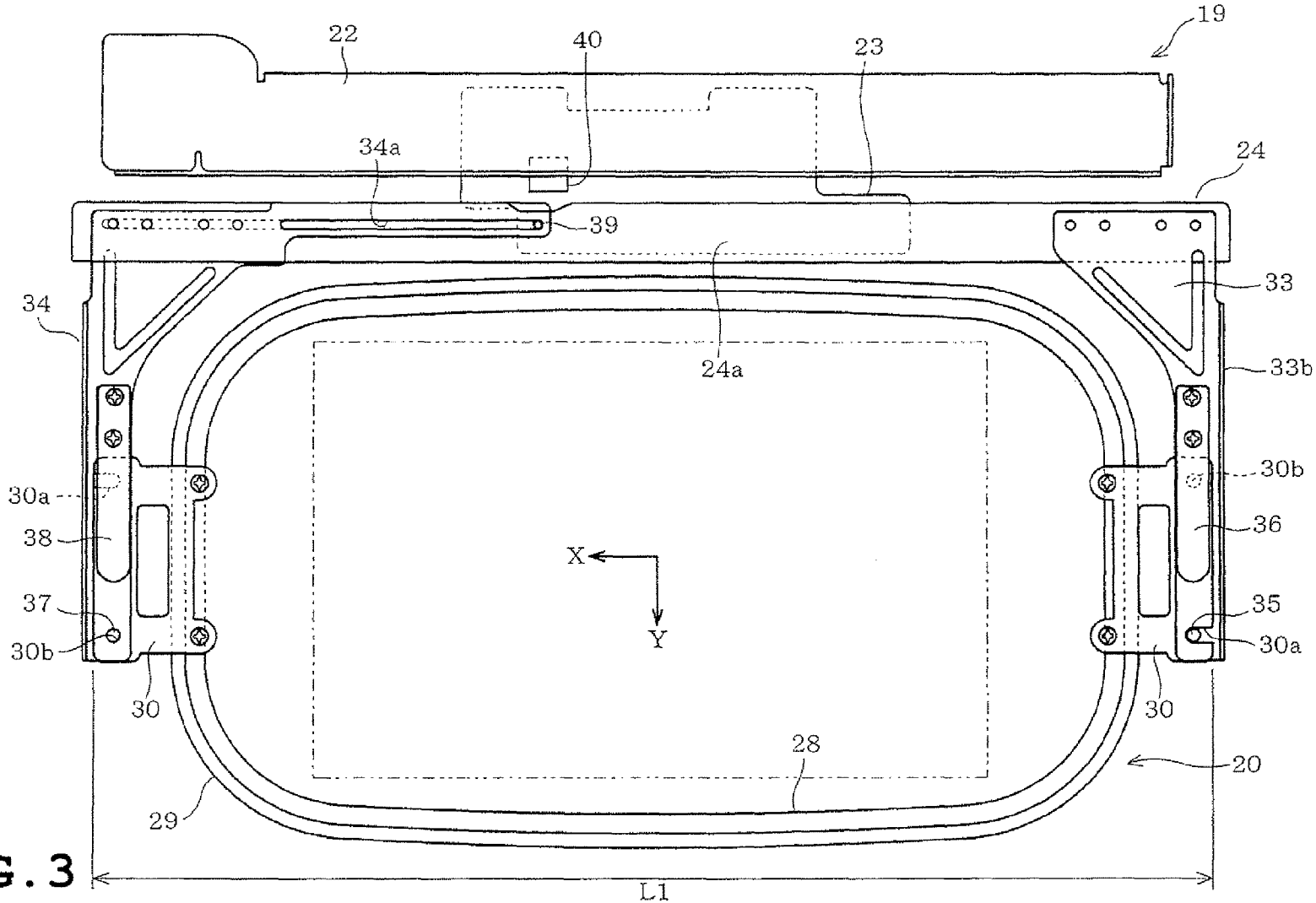
FIG. 3 is a plan view of a frame holder with an embroidery frame attached.

As also shown in FIG. 2, on the extremity of arm 4, needle bar case 7 is provided which is movable in the left and right direction which also referred to as the X-direction. As can be seen in FIG. 2, needle bar case 7 is longitudinally thin, and comes in a shape of a rectangular box. Needle bar case 7 contains a plurality of needle bars 8, six, in the present exemplary embodiment, aligned in the left and right direction so as to be movable up and down. Each needle bar 8 is subject to consistent upward bias toward the uppermost position shown in FIG. 2 by a coil spring not shown.

The lower ends of these needle bars 8 extend downward out of needle case 7 and sewing needle 9 used for embroidery sewing is detachably/interchangeably attached to them. The six needle bars 8 are identified by needle bar numbers 1 to 6, in this case, in ascending order from right to left. In the present exemplary embodiment, the leftmost specific needle bar 8 among the six needle bars 8, that is, the no. 6 needle bar 8, has punch needle 10 detachably attached to it instead of sewing needle 9. Punch needle 10 will be later described in detail.

Referring to FIG. 2, at the lower potion of needle bar 8, presser foot 11 for use in embroidery sewing is provided that is moved up and down in synchronism with needle bar 8. Presser foot 11 for the no. 6 needle bar 8 is removed when punch needle 10 is attached instead of sewing needle 9. Though not shown in detail, above needle bar case 7, six thread take-ups are provided, each dedicated to each of the six needle bars 8. The tip of each thread-take up protrudes forward through six vertical slits 12 defined on the front face of needle bar case 7 and is driven up and down in synchronism with the up and down movement of needle bar 8. Though also not shown, behind needle bar 8 which is placed in a position to be driven up and down by a later described needle-bar vertically moving mechanism, a wiper is provided.

Referring to FIG. 1, needle bar case 7 has upper cover 13 provided integrally with it that extends obliquely reward from its upper end. Though only mounting holes are shown, upper cover 13 is provided with six thread tension regulators along with six thread break sensors 14 provided on its upper end. The needle thread for embroidery sewing is drawn from the thread spools set to the thread supplier and is sequentially engaged with a threading route including components such as thread break sensor 14, thread tension regulators, and thread take-ups. When needle thread is finally passed through eye not shown of sewing needle 9, multi-needle embroidery sewing machine 1 is ready for embroidery sewing. By supplying different colors of needle threads to each of the six or five sewing needles 9, embroidery sewing operation with multiple needle colors can be executed consecutively by automatic switching of thread colors.

Though not shown in detail, pillar 3 is provided with sewing machine motor 15 only shown in FIG. 6. As known in the art, arm 4 is provided with components such as a main shaft driven by sewing machine motor 15, a needle-bar vertically drive mechanism that vertically moves needle bars 8 etc., by the rotation of the main shaft, and a needle-bar selector/driver mechanism that selects needle bar 8 by moving needle bar case 7 in the X-direction. The rotation of the main shaft also causes the loop taker shuttle to be driven in synchronism with the up and down movement of needle bar 8.

Needle-bar vertically moving mechanism is provided with a vertically moving element that is selectively engaged with needle bar clamp not shown provided at needle bar 8. The needle-bar selector/driver mechanism is driven by needle-bar selection motor 17 only shown in FIG. 6 to move needle bar case 7 in the X-direction to select either of needle bars 8, located immediately above needle hole 6*a*, to be engaged with the vertically moving element. Needle-bar selector/driver mechanism configured as described above selects one of the needle bars 8 and the selected needle bar 8 and the thread take-up corresponding to the selected needled bar 8 is moved up and down by the needle-bar vertically moving mechanism.

Then as shown in FIG. 1, in the front side of pillar 3 above support base 2, carriage 19 of transfer mechanism 18 shown in FIG. 6 is provided slightly above cylinder bed 5. Carriage 19 allows detachable attachment of embroidery frame 20 shown in FIG. 3 for holding a workpiece cloth to be embroidered or holder 21 shown in FIGS. 4A, 4B, and 5A for holding a sheet of workpiece W made of paper and plastic etc., on which a later described penetration forming operation is performed. In the present exemplary embodiment, embroidery frame 20 for holding the workpiece cloth and coming in various shapes and sizes are provided as accessories to multi-needle embroidery sewing machine 1.

As shown in FIGS. 1 and 3, carriage 19 is provided with Y-direction carriage 22, X-direction carriage 23 provided at Y-direction carriage 22, and frame holder 24 only shown in FIG. 3 attached to X-direction carriage 23. Though not shown in detail, transfer mechanism 18 includes a Y-direction drive mechanism provided within support base 2. Y-direction drive mechanism moves Y-direction carriage 22 freely in the Y direction, that is, the front and rear direction. Transfer mechanism 18 also includes an X-direction drive mechanism provided within Y-direction carriage 22. The X-direction drive mechanism transfers X-direction carriage 23 and frame holder 24 in the X direction, that is, the left and right direction. Embroidery frame 20 or holder 21 is held by frame holder 24 and is moved freely in the two predetermined directions, in this case, the X and Y directions by transfer mechanism 18.

To elaborate, Y-direction carriage 22 comes in a shape of an elongate, narrow box which extends in the X direction or the left and right direction over feet 2*a* of support base 2. As can be seen in FIG. 1, on the upper surface of left and right feet 2*a* of support base 2, guide groove 25 is defined that runs in the Y direction or the front and rear direction. Though not shown, the Y-direction mechanism is provided with a couple of transfer elements that vertically penetrates these guide grooves 25 to allow Y direction or front and rear movement along guide grooves 25. Both left and right ends of Y-direction carriage 22 is connected to the upper end of the couple of transfer elements respectively.

The Y-direction drive mechanism is configured by Y-direction drive motor 26 shown in FIG. 6 comprising a step motor, and a linear transfer mechanism including components such as a timing pulley and timing belt, etc. The linear transfer mechanism driven by Y-direction drive motor 26 moves the transfer elements to allow Y-direction carriage 22 to be moved in the Y direction or the front and rear direction.

Referring to FIGS. 1 and 3, a portion of X-direction carriage 23 protrudes forward from the lower front side of Y-direction carriage 22. X-direction carriage 23 comes in the form of a laterally wide plate and is supported slidably in the X-direction or the left and right direction by Y-direction carriage 22. The X-direction drive mechanism provided within Y-direction carriage 22 is configured by X-direction drive motor 27 shown in FIG. 6 comprising a step motor, and a linear transfer mechanism including a timing pulley and timing belt, etc. X-direction carriage 23 is moved in the X direction or the left and right direction by the above described configuration.

Next, a description will be given on frame holder 24 attached to X-direction carriage 23, and embroidery frame 20 and holder 21 serving as a holder being detachably attached to frame holder 24. First, a description will be given on embroidery frame 20 with reference to FIG. 3. Embroidery frame 20 comprises inner frame 28 generally formed as a rectangular frame with rounded corners, outer frame 29 fitted detachably on the outer periphery of inner frame 28, and a pair of connecting portions 30 mounted on both left and right ends of inner frame 28. Though not shown, the workpiece cloth is clamped between inner frame 28 and outer frame 29 to hold the workpiece cloth in a tense, stretched state within inner frame 28.

The left and right pair of connecting portions 30 is provided on embroidery frame 20 so as to have 180-degrees rotational symmetry in plan view. Connecting portions 30 have engagement grooves 30*a* and engagement holes 30*b* for attachment to frame holder 24. Though not shown, different types of embroidery frame 20 are provided that come in different shapes and sizes having varying embroidery areas and are selected interchangeably depending on the size of the workpiece cloth and the embroidery. The width in the left and right direction, that is, the measurement between the outer edges of the connecting portions 30 represented as L1 in FIG. 3, is configured to vary depending upon the type of embroidery frame 20. The variance in width L1 allows the later described detector to detect the type of embroidery frame 20 and whether or not holder 21 has been attached instead of embroidery frame 20. FIG. 3 shows embroidery frame 20 having the greatest width L1.

Figure 4A:
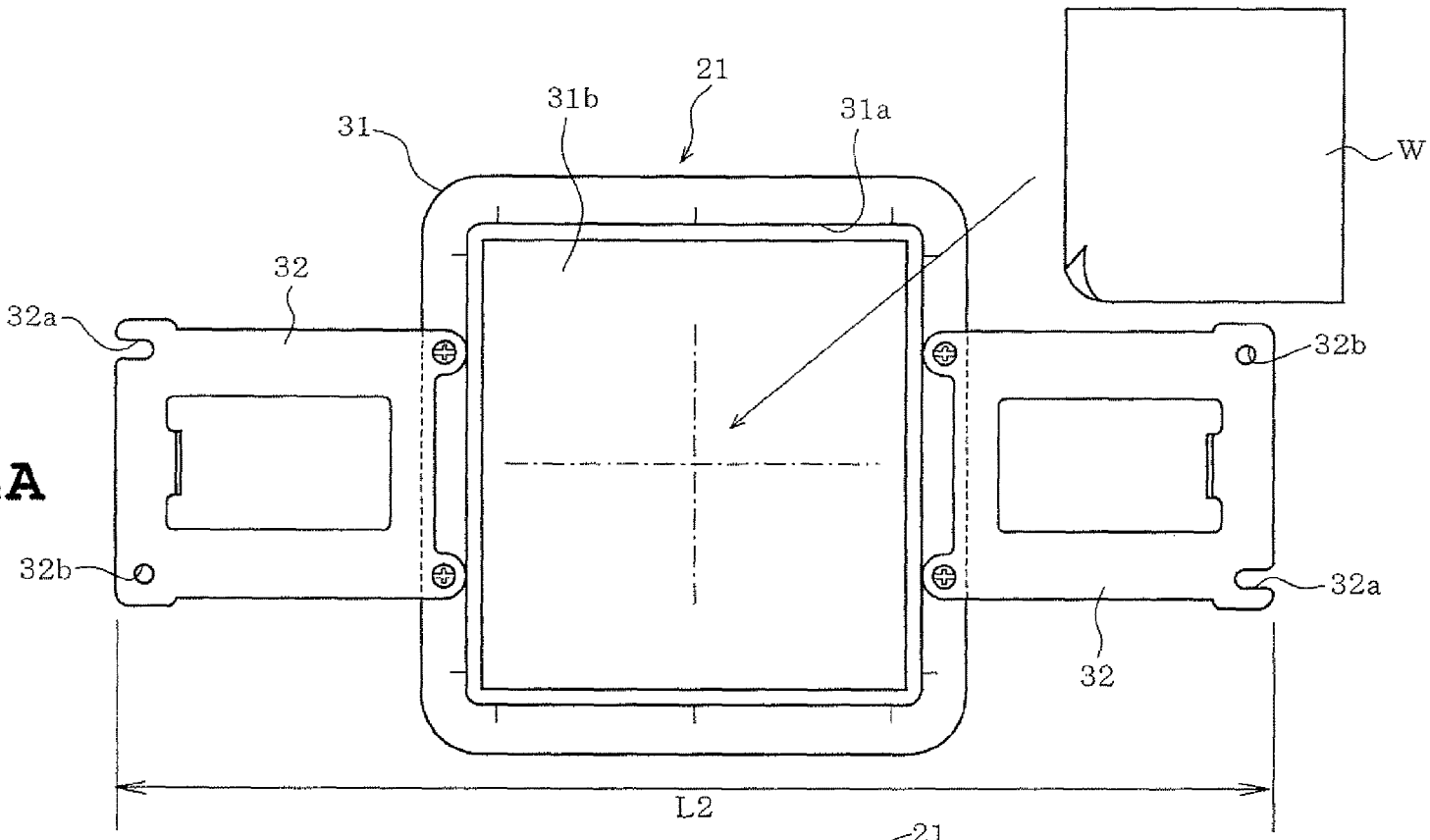
FIG. 4A is a plan view of a holder.
Figure 4B:
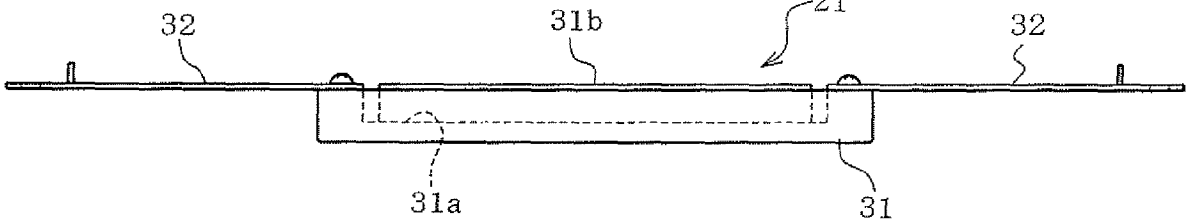
FIG. 4B is a front view of the holder.
Figures 5A, 5B:
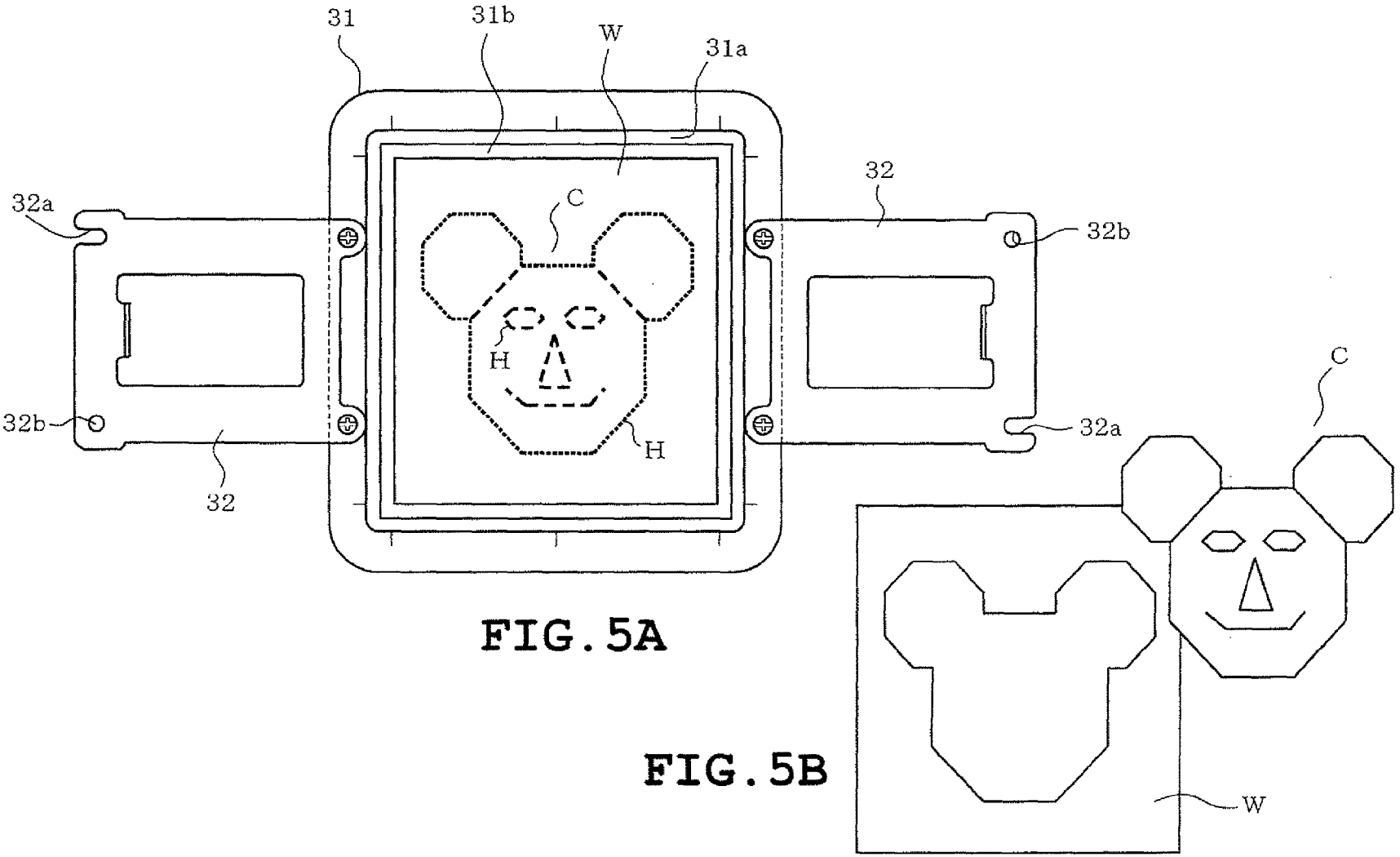
FIG. 5A is a plan view of a workpiece with penetrations formed on it.
FIG. 5B is a plan view showing the outline detached from the workpiece.

Next, a description will be given on holder 21. As shown in FIGS. 4A, 4B and 5A, holder 21 is provided with holder section 31 shaped as a rectangular plate with rounded corners and a pair of connecting portions 32 mounted on left and right ends of holder section 31. On the face of holder section 31 exclusive of its peripheral frame section, an enclosed bottom holder recess 31*a* is defined in a rectangular shape which contains elastic element 31*b*. Elastic element 31*b* is formed as a thin rectangular plate made of material such as foam resin or foam rubber. A sheet of workpiece W prepared in a rectangular shape corresponding to holder recess 31*a* is placed on the upper surface of elastic element 31*b* and is secured by fastening elements not shown such as a double-stick tape.

The left and right pair of connecting portions 32 is also disposed in 180-degrees rotational symmetry in plan view. Connecting portions 32 have engagement grooves 32*a* and engagement holes 32*b* for attachment to frame holder 24. The width in the left and right direction of holder 21, that is, the measurement between the outer edges of the connecting portions 32 represented as L2 in FIG. 4A, is configured to vary from width L1 of any given type of embroidery frame 20. Different types of holder 21 may also be provided depending on the shapes and sizes etc., of workpiece W as was the case of embroidery frame 20.

Frame holder 24 to which the above described embroidery frame 20 and holder 21 are attached/connected is configured as described below. Referring to FIG. 3, frame holder 24 is mounted unremovably on the upper surface of X-direction carriage 23. Frame holder 24 is provided with a stationary arm 33 and movable arm 34 mounted relocatably on stationary arm 33. Movable arm 34 is relocated in the left and right direction by the user depending upon the type, that is, width L1 or L2 of embroidery frame 20 or holder 21, whichever is attached.

Stationary arm 33 is placed over the right side upper surface of main section 24 of frame holder 24. Frame holder 24 is formed as an X-directionally elongate plate. Stationary arm 33 is provided with right arm 33*b* that is bent in a substantially right angle to extend forward. Provided on the upper surface extremity of right arm 33*b* are engagement pin 35 and leaf spring 36 for clamping connecting portions 30 and 32 provided rearward relative to engagement pin 35. Engagement pin 35 engages with engagement groove 30*a* of connecting portion 30 of embroidery frame 20 or engagement groove 32*a* of connecting portion 32 of holder 21.

Movable arm 34 is symmetrical in the left and right direction with right arm 33*b*. The base end or the rear end of movable arm 34 is mounted on main section 24*a* of frame holder 24 so as to be placed over the left side upper surface of main section 24*a*. Provided on the upper surface extremity of movable arm 34 are engagement pin 37 and leaf spring 38 for clamping connecting portions 30 and 32 provided rearward relative to engagement pin 37. Engagement pin 37 engages with engagement hole 30*b* of connecting portion 30 of embroidery frame 20 or engagement hole 32*b* of connecting portion 32 of holder 21.

On the base end or the rear end of movable arm 34, guide groove 34*a* is provided that extends in the left and right direction. Guide groove 34*a* allows engagement of guide pin 39 provided on the upper surface of main section 24*a* of frame holder 24. Thus, movable arm 34 is allowed to slide in the left and right direction relative to main section 24*a* of frame holder 24. Though not shown, main section 33*a* of stationary arm 33 is provided with a lock mechanism that allows movable arm 34 to be selectively locked at different predetermined positions. The position of movable arm 34 is relocated in the left and right direction through user operation of the lock mechanism.

The above described configuration allows the user to lock movable arm 34 at a position suitable for the type, in other words, the width such as L1 and L2 of embroidery frame 20 or holder 21 to be attached and proceed to attachment of embroidery frame 20 or holder 21 to frame holder 24. As exemplified in FIG. 3, in attaching embroidery frame 20 to frame holder 24, first, connecting portions 30 at the left and right ends of embroidery frame 20 are each inserted in the rearward direction from the front side of leaf spring 38 of movable arm 34 and leaf spring 36 of right arm 33*b*, respectively. Then, engagement pin 37 of movable arm 34 is engaged with engagement hole 30*b* of connecting portion 30 and engagement pin 35 of right arm 33*b* is engaged with engagement groove 30*a* of connecting portion 30. Thus, embroidery frame 20 is held by frame holder 24 and transferred in the X and Y directions by transfer mechanism 18. Holder 21 is attached to frame holder 24 in the same manner.

As shown in FIGS. 3 and 6, X-direction carriage 23 is provided with frame-type sensor 40 for detecting the type of embroidery frame 20 or holder 21 attached through detection of the position of movable arm 34. Though not shown, frame-type sensor 40 comprises a rotary potentiometer, for example, and is provided with a detection tip that is placed in contact with detection subject comprising a sloped surface, for example, provided on movable arm 34. The relocation of movable arm 34 in the left and right direction alters the height of the sloped surface placed in contact with the detection tip. This causes change in the rotational angle of the detection tip to cause variation in the output signals of frame-type detection sensor 40. As shown in FIG. 6, the output signal of frame-type detection sensor 40 is inputted to a later described control circuit 41 whereafter the type of embroidery frame 20 or holder 21 is determined by control circuit 41 based on the difference of the incoming output signal from frame-type detection sensor 40.

In the present exemplary embodiment, multi-needle embroidery sewing machine 1 is capable of executing a normal embroidery sewing operation on the workpiece cloth using six colors of embroidery thread as well as executing a penetration forming operation on workpiece W. Penetration forming operation is executed by impinging, in this case, piercing punch needle 10 dot by dot on the surface of workpiece W while transferring holder 21 in the X and Y directions by transfer mechanism 18 to form a plurality of penetrations H which is typically small holes on workpiece W as shown in FIG. 7. By forming penetrations on workpiece W, various patterns can be created on workpiece W. Apart from such pattern formation, forming of penetrations may be utilized, for instance, to cut workpiece W into a predetermined shape by forming penetrations H sequentially or consecutively at least along the outline of the created pattern.

In executing a penetration forming operation, sewing needle 9 provided on the leftmost, that is, the no 6 needle bar 8 of the six needle bars 8 is replaced by punch needle 10 as shown in FIG. 2. Punch needle 10 has a sharpened tip suitable for forming penetrations H on workpiece W and is shorter in length as compared to sewing needle 9. The length of punch needle 10 is so dimensioned such that, when needle bar 8 is lowered to the lowermost position, the tip of punch needle 10 pierces through workpiece W held by holder 21 at the lowermost point of reciprocation of needle bar 8 but stops short of penetrating through elastic element 31*b* provided at holder 21.

As can be seen in FIG. 7, diameter $\phi$B of a single penetration H formed by the penetration forming operation of punch needle 10 is specified, for instance, at 0.1 mm. Further, as shown in FIG. 2, presser foot 11 is removed from needle bar 8 having punch needle 10 attached to it. As one may readily assume, in case punch needle 10 is attached to the no. 6 needle bar 8, embroidery sewing operation is executed with the remaining five needle bars 8 no. 1 to 5 using embroidery threads of five colors or less.

FIG. 6 schematically indicates the electrical configuration of multi-needle embroidery sewing machine 1 according to the present exemplary embodiment with a primary focus on control circuit 41. Control circuit 41 is primarily configured by a computer, in other words, a CPU establishing connection with ROM 42, RAM 43, and external memory 44. ROM 42 stores items such as embroidery sewing control program, penetration forming control program, punch data generating program, and various types of control data. External memory 44 stores items such as various types of embroidery pattern data, line data shown in FIGS. 8A and 8B, and punch data.

Control circuit 41 receives input of operation signals produced from various operation switches 45 of the operation panel and is also responsible for controlling the display of LCD 46. The user, while viewing LCD 46, operates various operation switches 45 to select the sewing mode such as the embroidery sewing mode, penetration forming mode, and punch data generating mode and to select the desired embroidery pattern and draw pattern which is generated by formation of penetrations.

Control circuit 41 also receives input of detection signals such as detection signals from thread break sensor 14, frame-type detection sensor 40 provided at transfer mechanism 18, and other detection sensors 47 including main shaft rotational angle sensor for detecting the rational phase of the main shaft and consequently the elevation of needle bar 8. Control circuit 41 controls the drive of sewing machine motor 15 through drive circuit 48 and needle-bar selection motor 17 through drive circuit 49.

Control circuit 41 further controls the drive of Y-direction drive motor 26 for transfer mechanism 18 through drive circuit 50, and X-direction drive motor 27 through drive circuit 51 to drive frame holder 24 and consequently embroidery frame 20 and holder 21. Further, control circuit 41 executes thread cut operation by controlling picker motor 55 serving as a drive source for a picker not shown, thread cut motor 56 serving as a drive source for a thread cut mechanism not shown, and wiper motor 57 serving as drive source for a wiper not shown through drive circuits 52, 53, and 54, respectively.

Control circuit 41 executes the embroidery sewing control program which automatically executes the embroidery sewing operation on the workpiece cloth held by embroidery frame 20 under the embroidery sewing mode. When executing the embroidery sewing operation, the user is to select pattern data from a collection of embroidery pattern data stored in external memory 44. Embroidery sewing operation is executed by controlling components such as sewing machine motor 15, needle-bar selection motor 17, Y-direction drive motor 26 and X-direction drive motor 27 of transfer mechanism 18 based on the selected pattern data.

As well known, embroidery pattern data contains stroke-by-stroke needle drop point, that is, stroke-by-stroke data or transfer data indicating the amount of X direction or Y direction movement of embroidery frame 20. Further, pattern data contains data such as color change data that instructs switching of embroidery thread color, that is, switching of needle bar 8 to be driven; thread cut data that instructs the thread cut operation; and sew end data.

In the present exemplary embodiment, control circuit 41 automatically executes penetration forming operation on the surface of workpiece W held by holder 21 with punch needle 10 through software configuration, that is, the execution of penetration forming control program under the penetration forming mode. In the penetration forming operation, control circuit 41 controls sewing machine motor 15, needle-bar selection motor 17, and Y direction motor 26 and X direction motor 27 of transfer mechanism 18 based on the punch data.

Penetration forming operation is executed by selecting the no. 6 needle bar 8 and repeatedly moving the selected needle bar 8, that is, punch needle 10 up and down while moving punch workpiece W to the next penetration forming position when needle bar 8 is elevated. Punch data is primarily configured by a collection of stroke-by-stroke penetration forming position or the punching point of punch needle 10, in other words, stroke-by-stroke movement amount in the X and Y directions of holder 21, that is, punch workpiece W.

In the present exemplary embodiment, as later described through the flowchart, control circuit 41 executes penetration forming operation provided that attachment of holder 21 to frame holder 24 has been detected. This means that the activation of sewing machine motor 15 is not permitted even if execution of penetration forming operation is instructed by the user when attachment of holder 21 has not been detected or when attachment of embroidery frame 20 has been detected.

Further, in the present exemplary embodiment, as will also be later described through the flowcharts, control circuit 41 implements the feature of the punch data generating device, which generates punch data for execution of penetration forming operation through execution of punch data generating program. The punch data contains two types of data, namely, draw data and cut data.

The draw data is used for drawing one or more predetermined pattern(s) on workpiece W through formation of a plurality of penetrations H. The cut data is used for cutting along the outline of the one or more predetermined pattern(s) created on the workpiece W by sequentially forming penetrations H along the outline.

The formation of the punch data begins by extracting images of lines constituting the pattern from the pattern image data pre-stored in external memory 44. Then, based on the extracted line data, a plurality of penetrations, in other words, punch dots are plotted along each of the extracted lines to determine the locations where the penetrations are to be formed. In the present exemplary embodiment, control circuit 41 is configured to form penetration H at different pitches depending on whether the punch data specified is the draw data or the cut data when generating the punch data through execution of the punch data generating program. To elaborate, the location of the punch dots are specified so that penetration H is formed at a smaller pitch when formed based on the cut data as compared to when formed based on the draw data.

Figure 7A:
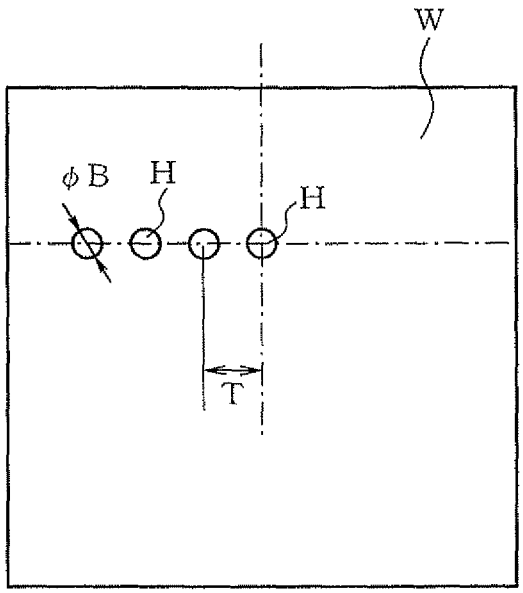
FIG. 7A is a plan view of the workpiece with penetrations formed at a pitch being relatively greater in width.
Figure 7B:
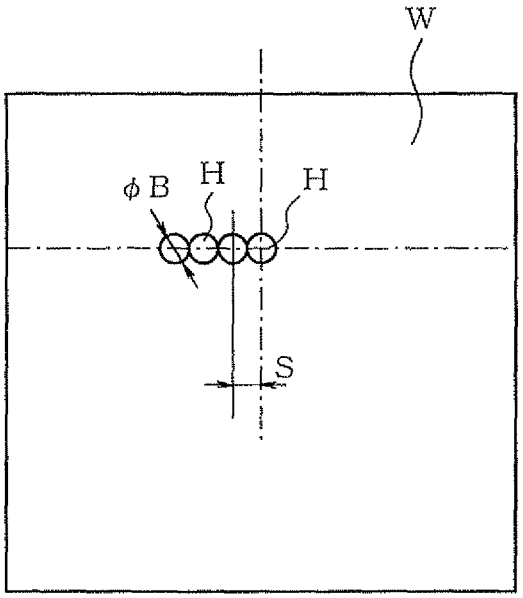
FIG. 7B is a plan view of the workpiece with penetrations formed at a pitch being relatively less in width.

For example, when generating the draw data (punch data type=draw data), hole-by-hole pitch T or simply pitch T at which the punch dots are specified on the extracted line is set at a value greater than diameter ϕB of penetration H such as 0.2 mm as shown in FIG. 7A. When generating the cut data (punch data type=cut data), pitch S at which the punch dots are specified on the extracted line is set at a value equal to or less than diameter ϕB of penetration H such as 0.1 mm as shown in FIG. 7B. As described above, control circuit 41 includes the features for both draw data generation and cut data generation, and thus, the user is given an option to select whether to generate each of the extracted lines as the draw data or the cut data. Alternatively, control circuit 41 may be configured to automatically select generation of the cut data when the extracted line constitutes an outline and otherwise proceed to generation of the draw data.

Further, control circuit 41 is configured so that, when generating or modifying the punch data as described above, the image of penetrations H being formed on workpiece W is shown on a modify screen presented on LCD 46. At this instance, control circuit 41 employs different representations for pattern images based on the draw data and for outline images based on the cut data. To elaborate, in the present exemplary embodiment, the pattern images based on the draw data are represented as a collection of broken lines having a length of certain extent, whereas the outline images based on the cut data are represented as a collection of small dots as exemplified in FIG. 10.

As will also be later described in detail along with the flowcharts, control circuit 41, which is responsible for generating the punch data is further is capable of modifying the punch data whenever required to modify how penetrations H are to be formed on workpiece W. In more direct terms, control circuit 41 modifies the draw data and or the cut data. To elaborate, control circuit 41, when generating the draw data, determines whether or not the pattern to be drawn contains a designated portion. If the pattern is determined to contain the designated shape, the draw data is modified, whereas if the pattern does not contain the designated shape, the draw data is not modified.

To elaborate, the present exemplary embodiment is configured to obtain the measurement of the angle θ of the vertex defined by interconnecting 3 consecutive punch dots within the draw data with a straight line. If the measurement yields, for instance, an acute angle of 45 degrees or less, that portion of the pattern is identified as a first designated portion. Further, an intersection or the point of contact between a line within the draw data comprising multiple punch dots and a line constituting the outline is identified as a second designated portion. Whenever the first or the second designated portion is encountered, control circuit 41 deletes the punch dots residing in the designated portion.

Further, the present exemplary embodiment, when generating the cut data, is configured to interpret multiplicity of lines categorized as cut type punch data as a single closed loop line. Then, such generated cut data is modified such that the first N number of punch dots, 5 punch dots in the present exemplary embodiment, are duplicated and appended at the end of the cut data such that the 5 punch dots are punched twice to form overlapping or redundant punch dots.

Figure 9:
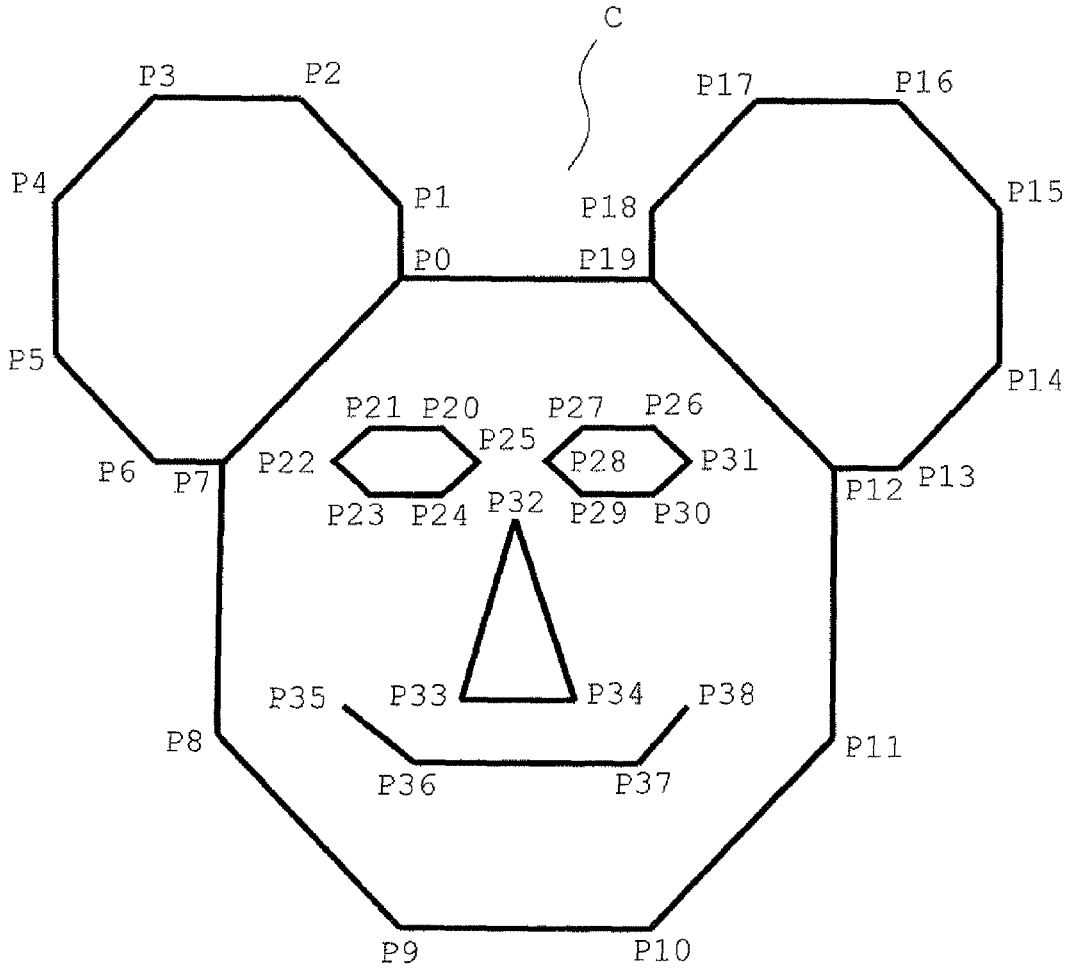
FIG. 9 exemplifies a character being the subject of punch data generation.

Next, the operation of the above described configuration will be described with reference to FIGS. 8A to 19B. As typically shown in FIG. 9, a description will be given through an example of generating the punch data for character C showing a face of a mouse with big ears. An example of the draw data generation will be discussed through drawing of patterns within the bounds or the outline of character C on workpiece W, such as drawing the parts of the face such as the eyes, nose, mouth and the boundaries between the face and the ears. An example of the cut data generation will be discussed through cutting of outlines of the patterns. FIGS. 8A and 9 indicate the configuration of line data for character C that is stored in the data memory. The line data contains parameters such as the line number of each line; the punch type of each line, that is, whether it constitutes the cut data or the draw data; and collection of position coordinates representing the line elements of each extracted line. The line elements are dots coming at the two ends of a segment within a chain of segments obtained by approximating the extracted line.

For instance, referring to FIG. 9, the line segments shaping the left ear of character C, that is, the line segments that provide the outline of the left ear portion of the entire outline hold a line parameter of: line number=1; punch type=cut; and line elements=P0, P1, P2, P3, P4, P5, P6, and P7. To give another example, the line segment constituting the boundary between the left ear and the face of character C hold a line parameter of: line number=2; punch type=draw; and line elements=P0 and P7. When executing the penetration forming operation, pattern drawing based on the draw data is prior in sequence to outline cutting based on the cut data. In each of the draw data and the cut data, the lines are processed in the ascending order of their line numbers.

As described above, control circuit 41, when in the punch data generating mode, extracts the lines, that is, the images of lines constituting the pattern from image data of patterns stored in external memory 44 or ROM 42, based on, for instance, user selection. Then, based on the line data, the punch data generation process is executed to locate a plurality of penetrations, in other words, punch dots along the extracted lines to generate the draw data and the cut data. The flowcharts shown in FIGS. 12 to 15 indicate the process flow of punch data generation process executed by control circuit 41.

Figure 12:
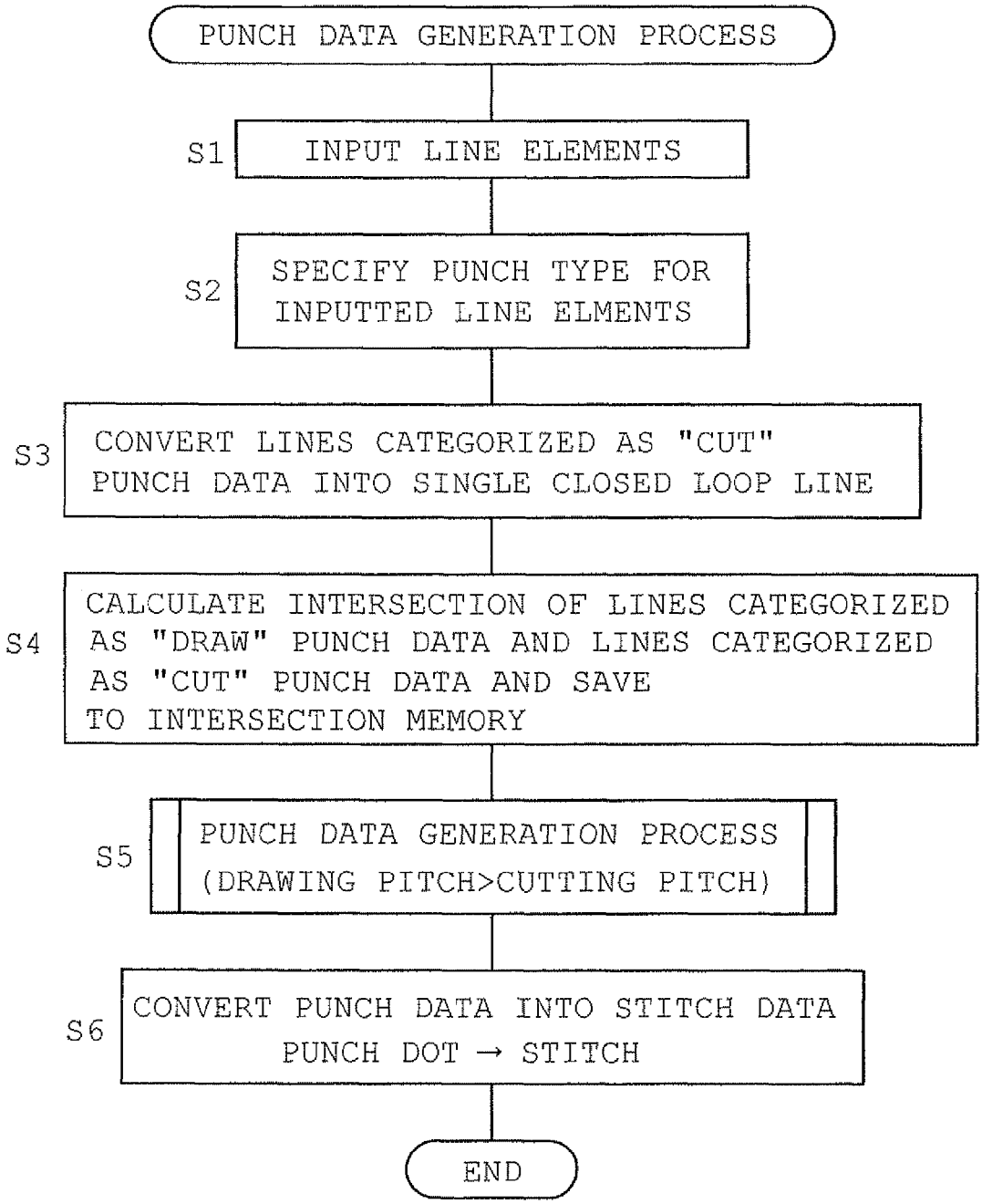
FIG. 12 is a flowchart showing the process flow of the main routine of a punch data generation process executed by a control circuit.
Figure 13:
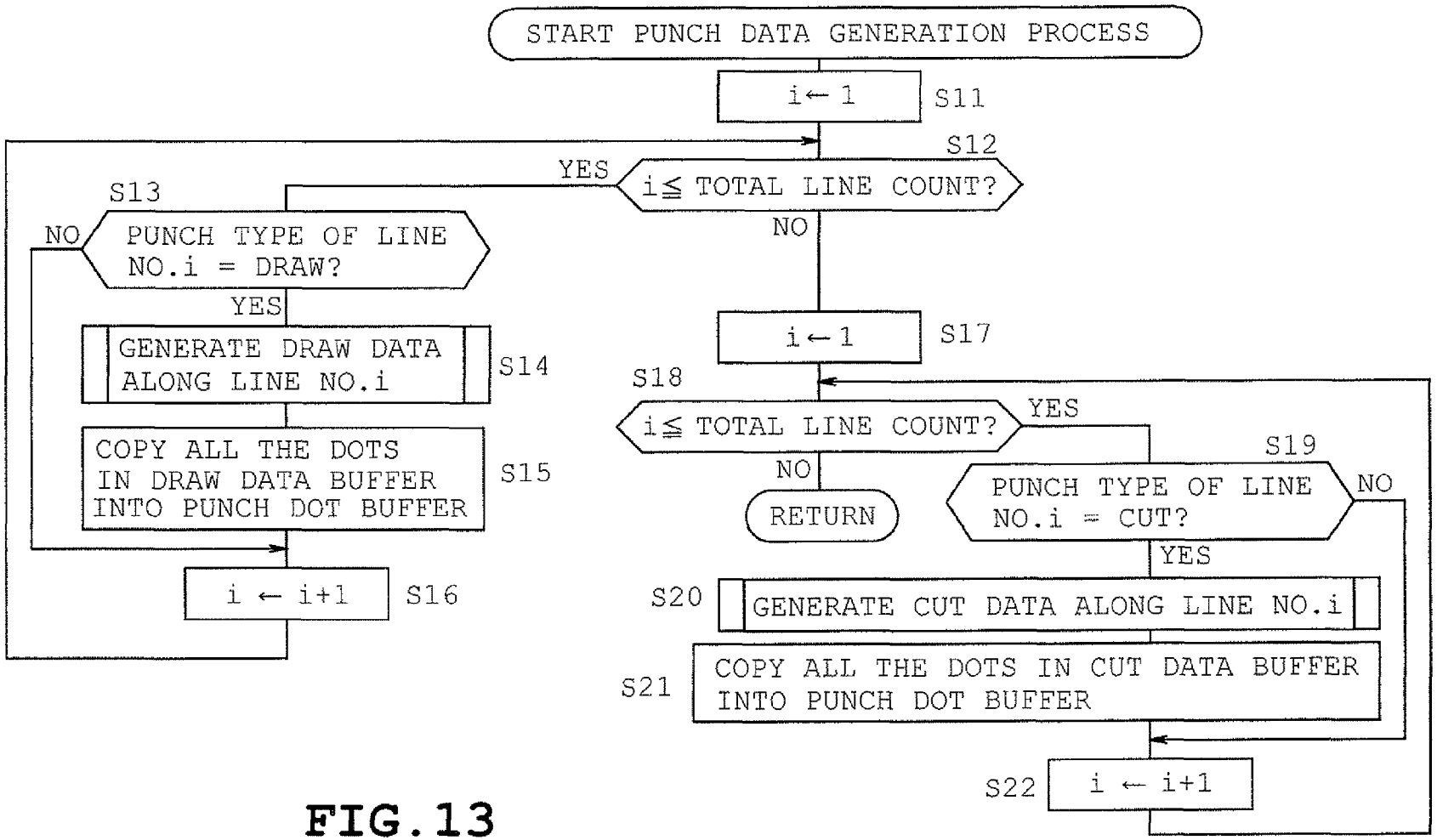
FIG. 13 is a flowchart detailing step S5 of the flowchart of FIG. 12.

Among them, flowchart of FIG. 12 indicates the main routine. The flowchart of FIG. 13 shows the details of the punch data generation process identified as step S5 in FIG. 12. The flowchart of FIG. 14 indicates the draw data generation process identified as step S14 in FIG. 13. The flowchart indicated in FIG. 15 shows the details of the cut data generation process identified as step S20 in FIG. 13.

That is, as shown in FIG. 12, at step S1, line elements of the lines constituting the pattern are inputted to obtain the line data. This step is executed by displaying the image of character C on LCD 46 and allowing the user to specify the line elements through the screen. Alternatively, control circuit 41 may be configured to automatically extract the lines and their line elements. Step S1 is followed by step S2 in which the type of punch data is specified for each line, in this case, for line numbers 1 to 10. This task may also be automated. Line data as such indicated in FIG. 8A is obtained from steps S1 and S2.

Then, at step S3, among the line data exemplified in FIG. 8A, the lines categorized as cut type punch data are interpreted as a single closed loop line. Thus, the four lines, namely, line no. 1, 3, 4, and 6 shown in FIG. 8A, are combined into a single line which is now identified as line no. 7 as indicated in FIG. 8B. Line no. 7 starts from line element P0 and thereafter extends along the outline, in other words, the entire outer shape of the pattern so as to form a loop that returns to line element P0 from line element P19. The transformation of cut lines into a single cut line causes the line numbers of draw type punch data to be renumbered to occupy the vacant line numbers.

At step S4, the intersections of lines categorized as draw type punch data and lines categorized as cut type punch data are calculated and saved to an intersection memory allocated in RAM 43. The intersection in this context indicates the portion where a line categorized as draw type punch data intersect or contact a line categorized as cut type punch data, in other words, a line constituting the outline of the pattern. The intersection is identified as the second designated portion. In the example shown in FIGS. 9 and 8B, line elements P0, P7, P12, and P19 are identified as the intersection, in other words, the second designated portion and saved in the intersection memory.

Then, at step S5, generation of punch data is executed based on the line data obtained as described above. The punch data generation process will be later detailed with the explanation of flowchart of FIG. 13. The punch dots are plotted such that the pitch at which penetrations H are formed based on the cut data is set is less than the pitch of penetrations H formed based on the draw data. For instance, when penetrations H based on the draw data are formed at a pitch of 0.2 mm, penetrations H based on the cut data may be formed at a pitch of 0.1 mm. At step S6, the punch data generated at step S5, in other words, the collection of location coordinates of punch dots are converted into stitch data, that is, X-directional and Y-directional transfer data for dot-by-dot transfer of holder frame 21 and consequently workpiece W. The generation of punch data is completed by the above sequence of steps.

Referring now to the flowcharts of FIGS. 13 and 15, the punch data generation process will be described in detail. The flowchart indicated in FIG. 13 begins with step S11 in which 1 is assigned to variable i that indicates the line number. Then, step S12 determines whether variable i is equal to or less than the total count of lines. In the example shown in FIG. 8B, the total count of lines amount to 7. If variable i is equal to or less than the total count of lines (step S12: Yes), the process proceeds to step S13 which determines whether or not the $i^{th}$ line, or line number i is draw type punch data. If determined to be a cut type punch data (step S13: No), the process proceeds to step S16 which increments variable i by 1 and returns the process flow back to step S12. If determined to be a draw type punch data (step S13: Yes), the process proceeds to step S14 and the draw data is generated for forming penetrations H along line no. i.

Figure 14:
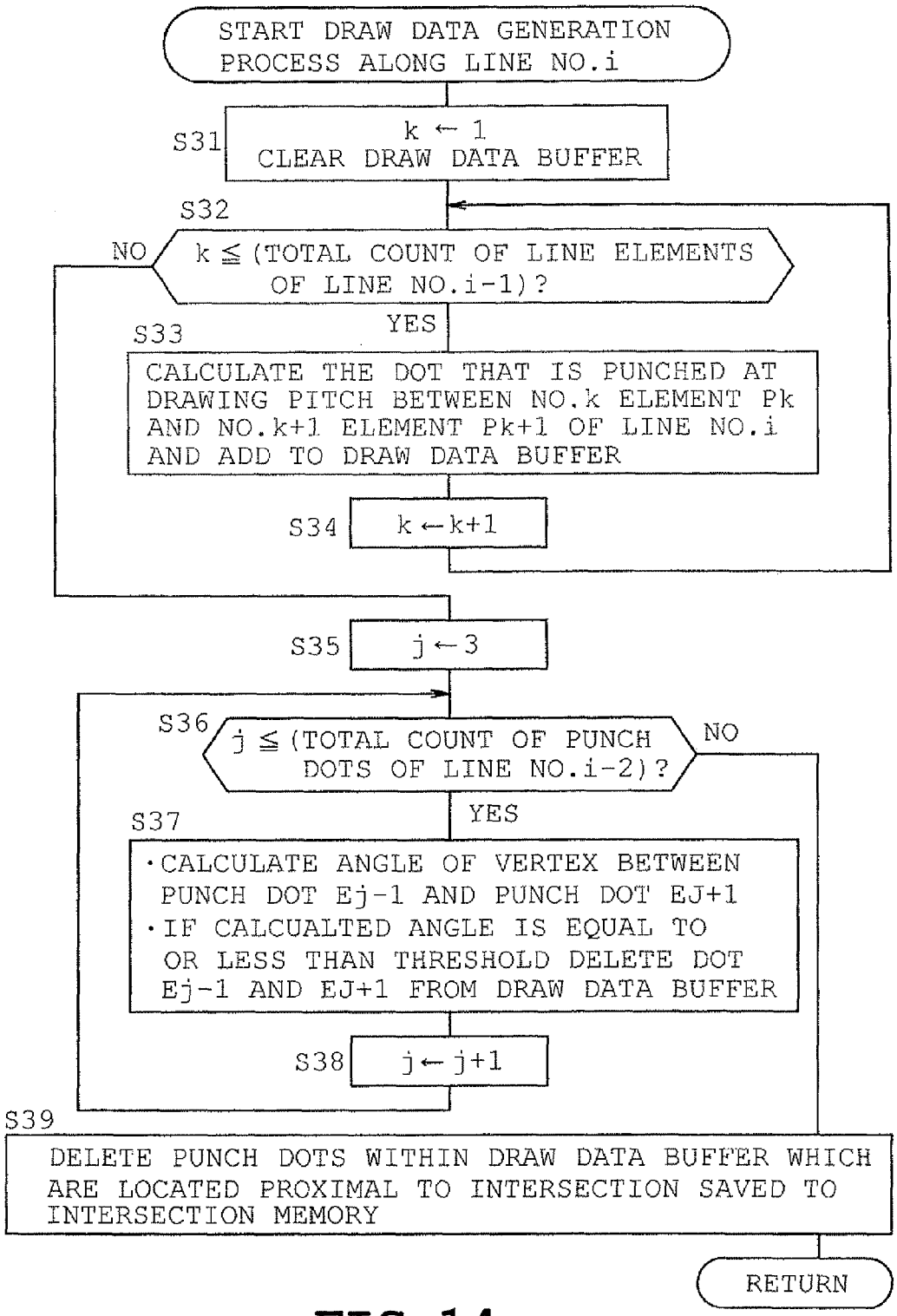
FIG. 14 is a flowchart detailing step S14 of the flowchart of FIG. 13.
Figure 15:
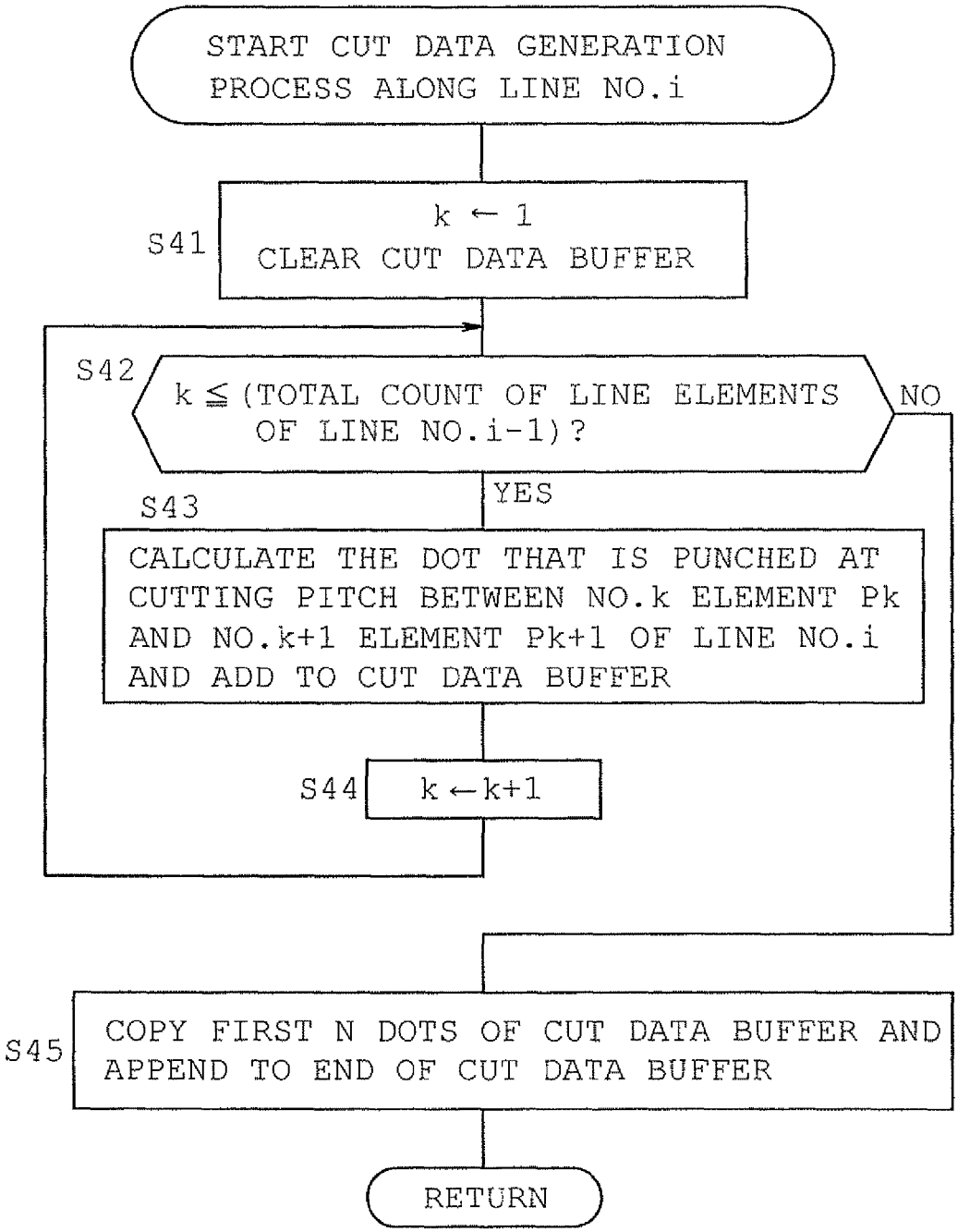
FIG. 15 is a flowchart detailing step S20 of the flowchart of FIG. 13.

The draw data generation process executed at step S14 of flow chart of FIG. 13 is broken down into substeps in flowchart of FIG. 14. The flowchart begins with step S31 which assigns 1 to variable k that indicates the numbering for identifying a line element provided in a given line number i and clears the draw data buffer. Step S32 determines whether or not variable k is equal to or less than ("total count of line elements"−1). For instance, in line no. 1 of the examples shown in FIGS. 8B and 9, "total count of line elements" amounts to 2, whereas in line no. 3, "total count of line elements" amounts to 7.

If variable k is equal to or less than ("total count of line elements"−1) (step S32: Yes), the process proceeds to step S33. Step S33 calculates the position of the punch dots arranged at pitch T, exemplified as 0.2 mm in the present exemplary embodiment, that resides on and between a given line element Pk and line element Pk+1 within line no. i and adds the calculated punch dots into the draw data buffer. As described earlier, line element Pk denotes line element no. k and line element Pk+1 denotes line element no. k+1. The same denotation applies throughout the description when numberings of lines or elements are generalized by variables such as k and i. Step S34 increments variable k by 1 and returns the process flow to step S32. The above described process generates the draw data for sequential formation of multiplicity of penetrations H formed at pitch T along line no.

If variable k exceeds ("total count of line elements"−1) (step S32: No), the process proceeds to step S35 and 3 is set to variable j which indicates the numbering of the punch dots. At step S36, a determination is made as to whether or not the value assigned to variable j is equal to or less than "total count of punch dots in line no. i"−2). If determined that the value assigned to variable j is equal to or less than ("total count of punch dots in line no. i"−2) (step S36: Yes), the process proceeds to step S37 to find the first designated portion and if found, executes the modifying process.

Figure 16:
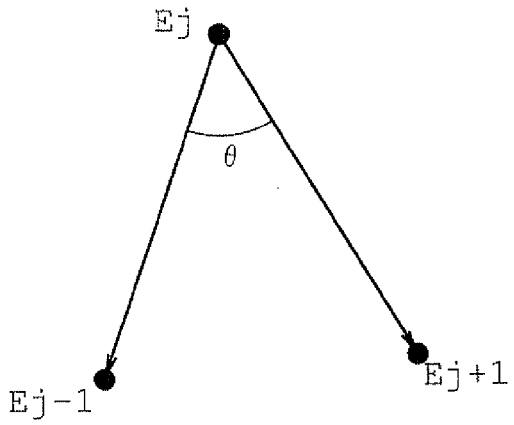
FIG. 16 is a diagram explaining how the angle is to be calculated.

At step S37, the measurement of angle θ is obtained which represents the angle of vertex formed when 3 three consecutive punch dots Ej−1, Ej, and Ej+1, having punch dot Ej located in the center, are connected by a straight line as can be seen in FIG. 16. Then, angle θ is evaluated by comparison with a predetermined threshold angle of, for instance, 45 degrees. In obtaining angle θ, a vector starting from dot Ej and terminating at dot Ej−1 is obtained as well as a vector starting from dot Ej and terminating at dot Ej+1. These vectors can be represented by the following equations (1) and (2). Thus, cos θ can be obtained by equation (3).

$$\overrightarrow{EjEj-1} = (v1, v2) \tag{1}$$

$$\overrightarrow{EjEj+1} = (W1, W2) \tag{2}$$

$$\cos\theta = \frac{v1w1 + v2w2}{\sqrt{v1^2 + v2^2} \cdot \sqrt{w1^2 + w2^2}} \tag{3}$$

Figure 17A:
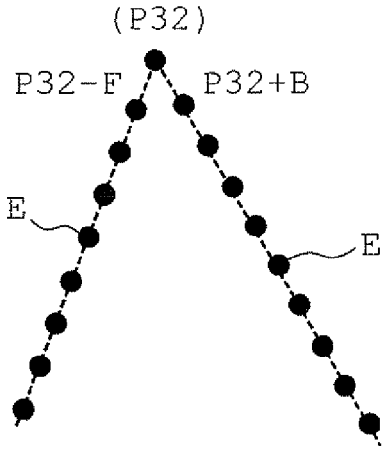
FIG. 17A shows the layout of the punch dots constituting an acute angled portion prior to modification.
Figure 17B:
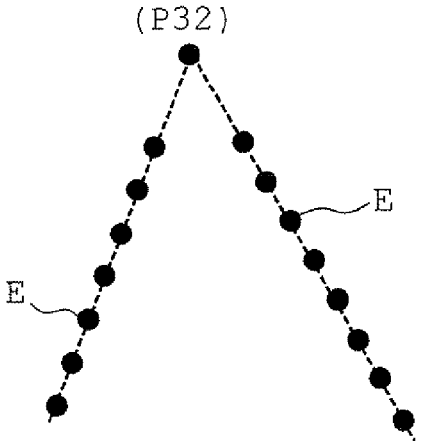
FIG. 17B shows the layout of the punch dots constituting an acute angled portion after modification.

If angle θ is equal to or less than the predetermined threshold angle of 45 degrees, meaning that, angle θ is evaluated as the first designated portion, dots Ej−1 and Ej+1 are deleted from the draw data buffer. For example, as can be seen in FIGS. 17A and 17B, if the draw data contains the first designated portion which comprises an alignment of punch dots E defining an acute angle, as typically represented graphically on the upper end of the nose of character C illustrated in FIG. 9, the draw data is modified to delete unnecessary dots. To elaborate, the 2 punch dots P32−F and P32+B adjacent the sharpened tip of the nose, or the vertex represented as line element 32 in FIGS. 17A and 17B, are deleted. Then, at step S38, variable j is incremented by 1 and steps S36 and 37 are repeated.

Figure 18A:
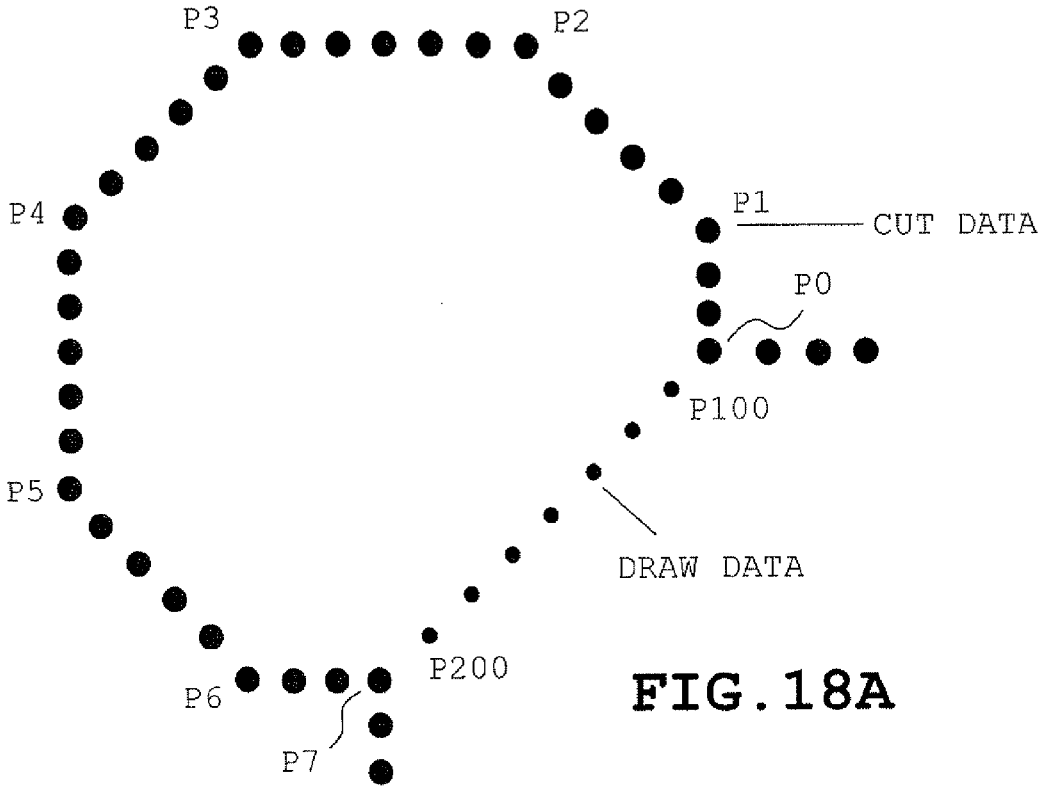
FIG. 18A shows the layout of the punch dots constituting an intersection prior to modification.
Figure 18B:
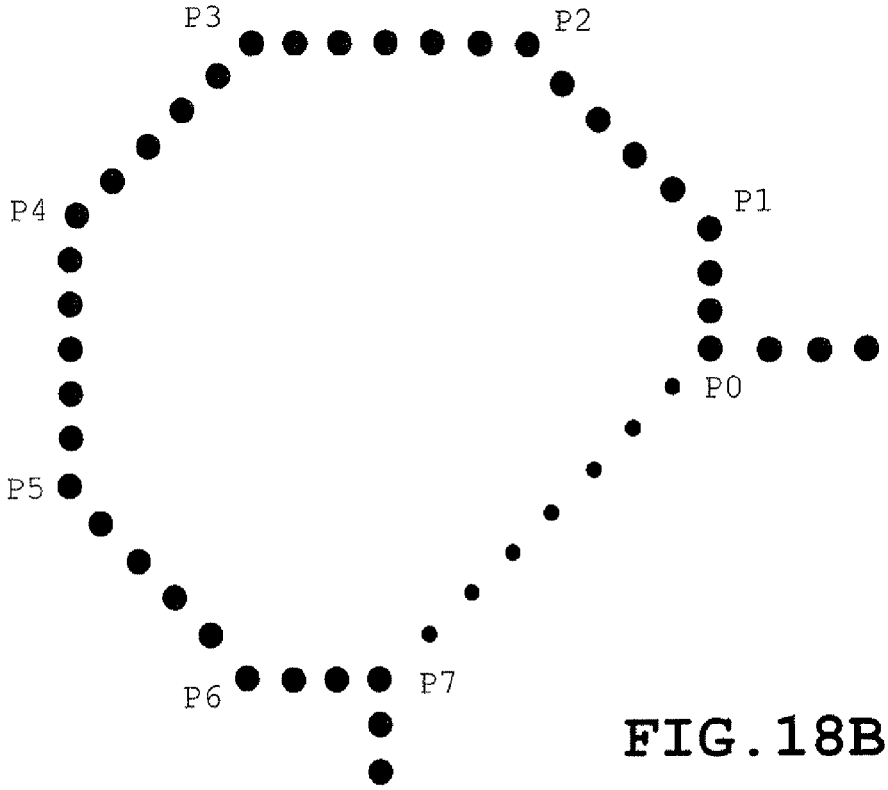
FIG. 18B shows the layout of the punch dots constituting an intersection after modification.

When variable j exceeds ("total count of punch dots in line no. i"−2) (step S36: No), the process proceeds to step S39 to find the second designated portion and if found, executes the modifying process. At step S39, some of the punch dots stored in the draw data buffer that are identified as the second designated portion, in other words, the punch dots identified as the draw type punch data that intersect or contact the lines constituting the outline of the pattern is deleted. More specifically, step S4 of FIG. 12 reads out the data pertaining to the intersections already saved in the intersection memory and the punch dots located in the proximity of the intersections are deleted. In the example shown in FIGS. 18A and 18B illustrating the left ear of character C, the two terminal punch dots (P100 and P200) at both ends of the line running between line elements P0 and P7 are deleted. Generation of the draw data pertaining to line no. i is completed by the above sequence of steps to terminate the process.

The process flow, then, returns to FIG. 13, and proceeds to step S15 that copies all the draw data, representing the position data of multiplicity of punch dots, written into the draw data buffer, into the punch dot buffer. Then, step S16 increments variable i by 1 and the process flow returns to step S12. By repeating step S12 onwards, the draw data is generated for lines identified as draw type punch data, in this case, lines no. 1 to 6 as exemplified in FIG. 8B. When variable i exceeds the total count of lines, in this case, when i=8, step S12 makes a No decision and terminates the draw data generation process. The above sequence of steps modify, in this case, deletes a part of the punch dots corresponding to the first and the second designated portions.

After completing the draw data generation process, the control flow proceeds to the cut data generation process. The cut data generation process begins with step S17 in which 1 is assigned to variable i that indicates the numbering for identifying the lines and the subsequent step S18 determines whether or not variable i is equal to or less than the total count of lines, which, in this case, is 7. If variable i is equal to or less than the total count of lines (step S18: Yes), the process proceeds to step S19 which determines whether or not line no. i is a cut type punch data. If determined to be a draw type punch data (step S19: No), the process proceeds to step S22 and returns to step S18 after incrementing variable i by 1. If line no i is indeed a cut type data (step S19: Yes), the process proceeds to step S20 and the cut data is generated for forming penetrations H along line no. i.

The cut data generation process executed at step S20 is broken down into substeps in the flowchart of FIG. 15. The flowchart begins with step S41 which assigns 1 into variable k that indicates the numbering for identifying a line element provided in a given line number i and clears the cut data buffer. Step S42 determines whether or not variable k is equal to or less than ("total count of line elements"−1). For instance, in line no. 7 of the examples shown in FIG. 8B, "total count of line elements" amounts to 21.

If variable k is equal to or less than ("total count of line elements"−1) (step S42: Yes), the process proceeds to step S43. Step S43 calculates the position of the punch dots arranged at pitch 5, exemplified as 0.1 mm in the present exemplary embodiment, that resides on and between a given line element Pk and line element Pk+1 within line no. i and adds the calculated punch dots into the cut data buffer. Step S44 increments variable k by 1 and returns the process flow to step S42. If variable k exceeds ("total count of line elements"−1) (step S42: No), the process proceeds to step S45 to modify the cut data.

The modification of the cut data carried out at this instance appends N number of punch dots, 5 punch dots for example, at the end of the cut data in order to assure that penetrations formed at the initial stages of the penetration forming operation is punched through redundantly, in this case, twice. In other words, 5 punch dots are added to the cut data so that the penetrations formed by the initial strokes of the punch needle made at the beginning of the penetration forming operation are punched redundantly.

Figure 19A:
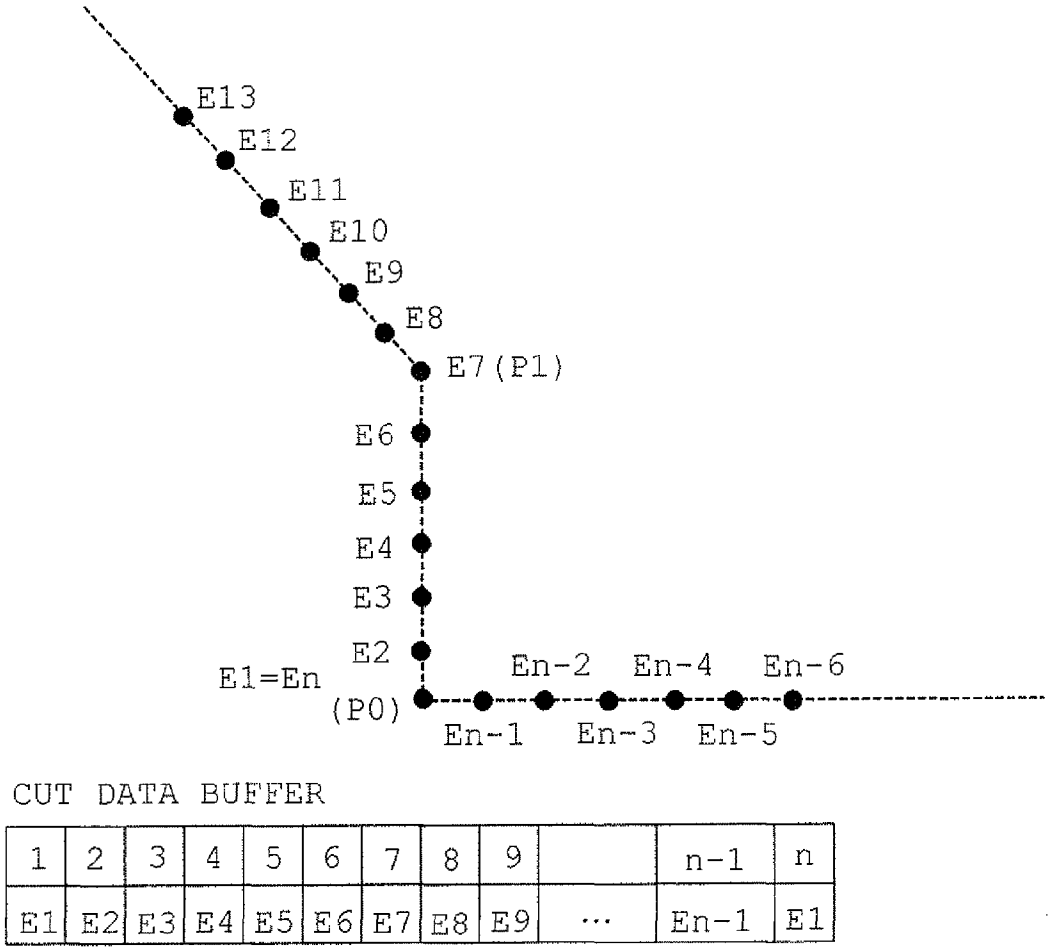
FIG. 19A shows the cut data prior to modification.
Figure 19B:
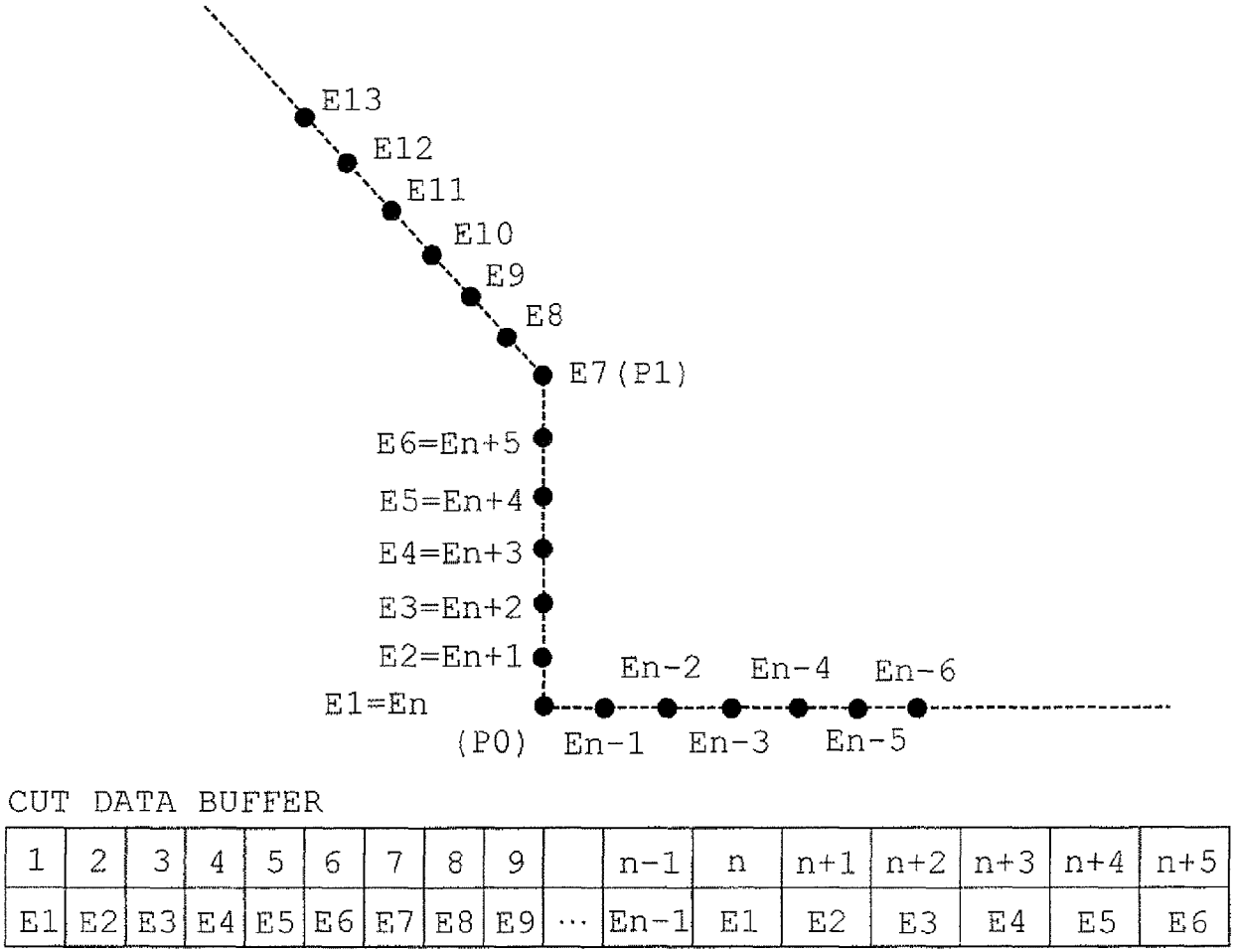
FIG. 19B shows the cut data after modification.

For example, in the cut data generation process (step S43) indicated in FIG. 19A, punch dot E1 is punched through first and is followed by punch dots E2, E3, E4, E5, E6 . . . and so forth to carry on with the formation of the penetrations. The formation of penetration proceeds to En−3, En−2, En−1, and terminates at En. The last punch dot En coincides with the first punch dot E1. The modification described above adds 5 punch dots En+1, En+2, En+3, En+4, and En+5 at the end of the cut data as indicated in FIG. 19B. The five punch dots En+1, En+2, En+3, En+4, and En+5 coincide with punch dots E2, E3, E4, E5, and E6, respectively.

Upon completion of the above described sequence of steps, the process flow returns to FIG. 13, and proceeds to step S21 that copies all the modified cut data, representing the position data of multiplicity of punch dots, having been written into the cut data buffer, into the punch dot buffer. Then, step S22 increments variable i by 1 and the process flow returns to step S18. By repeating step S18 onwards, the cut data, is generated for all the lines identified as cut type punch data. When variable i exceeds the total count of lines, in this case, when i=8, step S18 makes a No decision and terminates the cut data generation process.

Thus, punch data is created that draws patterns within the bounds or outline of character C and that cuts character C along the outline through formation of multiplicity of penetrations H on workpiece W. The punch data is a collection of stroke-by-stroke punch position of punch needle 10 which is an equivalent of collection of stroke-by-stroke movement amount of holder 21 in the X and Y directions. As described above, the punch data is generated such that suitable pitch is specified for formation of penetration H for the draw type punch data and the cut type punch data, respectively.

Figure 10:
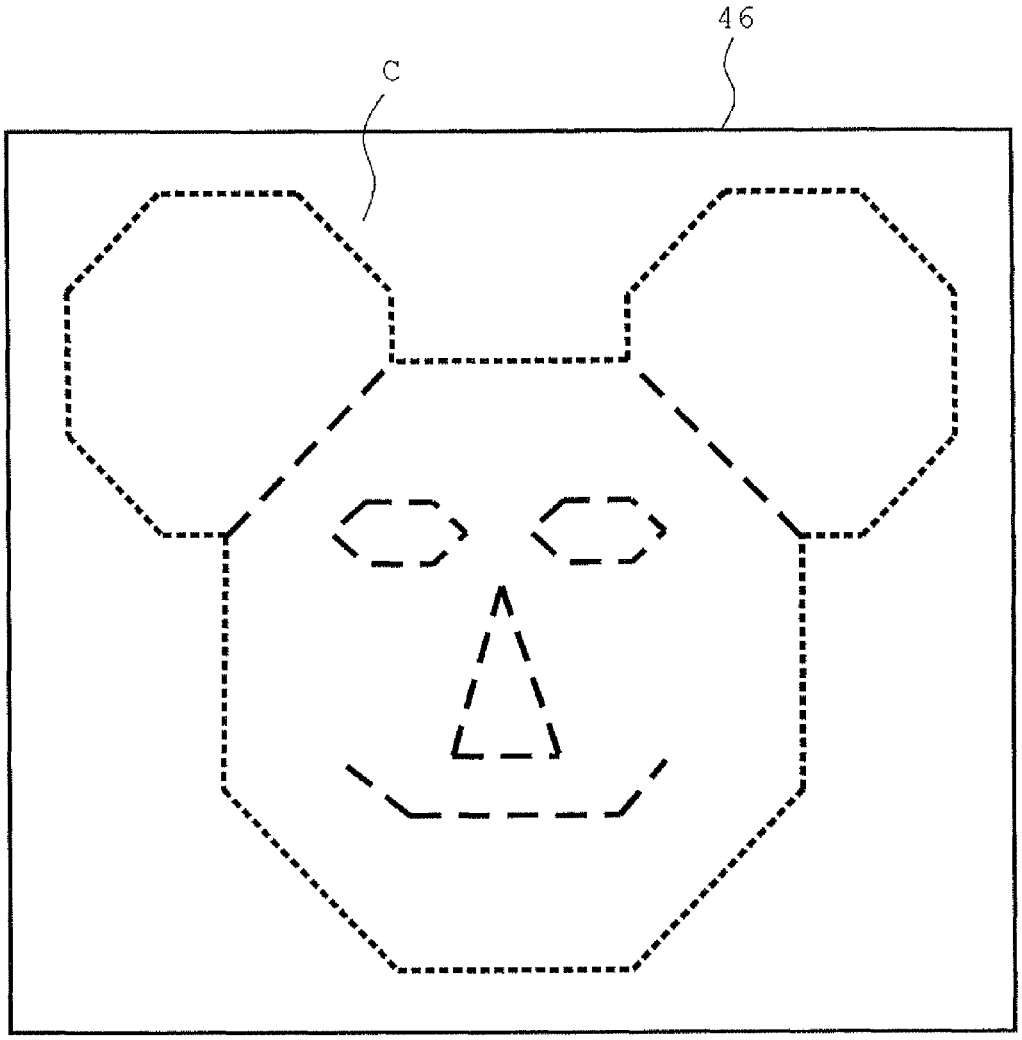
FIG. 10 is an example of how a liquid crystal display shows lines constituting a given character design.

During the punch data generation process, a screen is displayed on LCD 46 that shows an image of character C which is represented by multiplicity of penetrations H formed on workpiece Was exemplified in FIG. 10. The images of patterns based on the draw data and the images of outlines based on the cut data are represented differently on the screen. For instance, the pattern images based on the draw data are represented as a collection of broken lines having a length of certain extent, whereas the outline images based on the cut data are represented as a collection of small dots. Such distinction in the presentation of the draw data and the cut data provides good visibility to the user.

In addition to the execution of a normal sewing operation, multi-needle embroidery sewing machine 1 according to the present exemplary embodiment is capable of executing a penetration forming operation on workpiece W such as a sheet of paper by using the punch data generated as described above. In executing the penetration forming operation, the user is to attach punch needle 10 on the number 6 needle bar 8 as well as attaching holder 21 on frame holder 24. Then, the punch data of the desired pattern is selected and read to start the penetration forming operation.

In the present exemplary embodiment, control circuit 41 of multi-needle embroidery sewing machine 1 starts the penetration forming operation by activating sewing machine motor 15 provided that attachment of holder 21 to frame holder 24 has been detected. This means that the penetration forming operation is not permitted when attachment of embroidery frame 20 has been detected, in which case, an error alert is issued. Likewise, the attempt to execute an embroidery sewing operation with the attachment of holder 21 is not permitted and will similarly result in an error alert.

Based on the information provided in the punch data, control circuit 41 selectively drives the number 6 needle bar 8 having punch needle 10 attached to it by way of needle-bar selector motor 17 while moving holder 21 and consequently workpiece W in the X and Y directions through control of transfer mechanism 18. Thus, punch needle 10 is pierced through a predetermined position of workpiece W in the predetermined sequence according to the information provided in the punch data to form multiplicity of penetrations H on workpiece W as shown in FIG. 5A.

Figure 11:
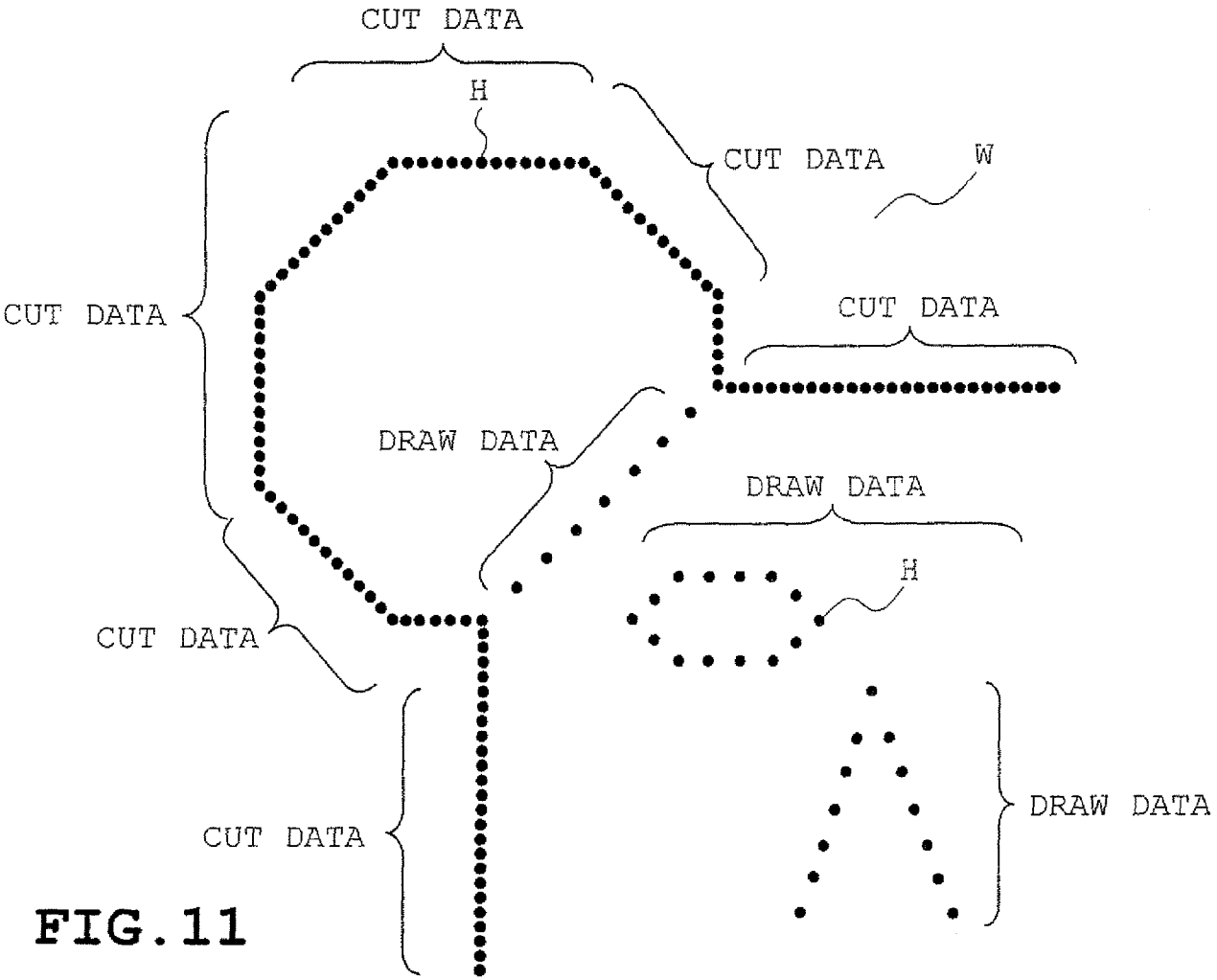
FIG. 11 is an enlarged view partially describing how the penetrations are formed on the workpiece.

As exemplified in the exploded view of the left ear portion of character C provided in FIG. 11, the penetration forming begins with formation of multiplicity of penetrations H on workpiece W in accordance with the information provided in the draw data to draw predetermined patterns, in this case, the facial elements such as the eyes, the nose, and the mouth of character C as well as the boundary between the face and the ears. Then, multiplicity of penetrations H are further formed sequentially and consecutively along the outline of character C based on the cut data. Diameter ϕB indicating the size of penetration H is constant irrespective of whether it is formed for pattern drawing or outline cutting. The pitch at which penetrations H are formed varies depending on whether it is formed for pattern drawing or outline cutting, where a predetermined spacing is given between penetrations H formed for pattern drawing, whereas penetrations H formed in outline cutting is given no spacing between them, meaning that the adjacent penetrations H overlaps or is connected to one another.

Thus, as the result of outline cutting, the collection of penetrations H exhibit a cut that extends along the outline of character C. As a result, character C can be removed from workpiece W along its outline as can be seen in FIG. 5B. When forming penetrations based on the cut data, the initial strokes taken at the initial stages of the penetration forming operation and the final strokes taken at the final stages of the penetration forming operation with punch needle 10 may lack in momentum because they involve acceleration and deceleration of sewing machine motor 15 which in turn may produce imperfect penetrations H. However, because the present exemplary embodiment is configured to modify the cut data such that punch dots are appended at the end of the cut data, the punch dots punched through by the initial strokes after the start of the penetration forming operation is punched through redundantly to ensure that penetrations are formed successfully on workpiece W so as not to leave any uncut portions when cutting the outline of the pattern apart from workpiece W.

When forming penetrations based on the draw data, because penetrations H are formed at greater pitch as compared to the pitch applied to penetrations H formed by the cut data, penetrations H remain spaced apart from each other, without interconnecting, to draw the pattern as designed. However, as the pattern becomes detailed or complex in design to include, for instance, sharpened points that define acute angles, the punch dots may fail to precisely reproduce such designs. For instance, the attempt to draw a sharpened tip may result in a broken off or a porous tip caused by 3 or more connected penetrations H. Further, the boundary of the draw-data based penetration and the cut-data based penetration may suffer unwanted cuts originating from the cut-data based penetration. To address such risks, the present exemplary embodiment modifies the draw data as well. To elaborate, the draw data is parsed to determine the presence/absence of the first designated portion having an acute angle and the second designated portion where a draw-data based line and a cut-data based line intersect or come in contact. On encountering the first and/or the second designated portions, a part of the punch dots residing at such designated portions are modified so a to be deleted to render such portion less cut prone, to prevent tear of workpiece W more effectively during pattern drawing.

The present exemplary embodiment allows multi-needle embroidery sewing machine 1 to be utilized as a device to create patterns on a sheet of workpiece W and as a device to cut workpiece W into the desired shape through formation of penetrations H by applying punch needle 10. Because the above configuration does not require optional accessories such as cutter device or a separate cutting plotter, functional advantages offered by such additional devices can be achieved in less cost. Further, because the above configuration allows pattern drawing and cutting to be rendered in sequenced consecutive tasks without having to remove workpiece W during the transition from pattern drawing to cutting, no misalignment occurs between the drawn pattern and the outline along which the pattern is cut.

The present exemplary embodiment further allows multi-needle embroidery sewing machine 1 to function as a punch data generator being subdivided into a draw data generator for generating the draw data and cut data generator for generating the cut data. Such configuration advantageously allows generation of punch data that enables drawing of the desired pattern on workpiece W and cutting of workpiece W along the outline of the drawn pattern. Still further, pitch S at which penetrations H are formed based on the cut data is configured to be less than pitch T at which penetrations are formed based on the draw data. Thus, appropriate cuts can be made reliably on workpiece W while advantageously only requiring a single type of punch needle 10.

The present exemplary embodiment is still further configured to modify the cut data so that the punch dots are appended to the cut data such that the punch dots punched through by the initial strokes taken at the initial stages after the start of the penetration forming operation is punched through redundantly. Such configuration ensures that penetrations are formed reliably on workpiece W so as not to leave any uncut portions when cutting the outline of the pattern. Further, when determining the presence of the designated portion(s) in the shape of the pattern, a part of the punch dots residing at such designated portions are modified so a to be deleted. Thus, tearing of workpiece W can be prevented more effectively during pattern drawing. In the present exemplary embodiment, the designated portion includes a portion of the pattern having an acute angle and a portion of the pattern where a draw-data based line and a cut-data based line intersect or come in contact. On encountering designated portions, a part of the punch dots residing at such designated portions are modified so as to be deleted to prevent tearing of workpiece W even more effectively.

Figure 20:
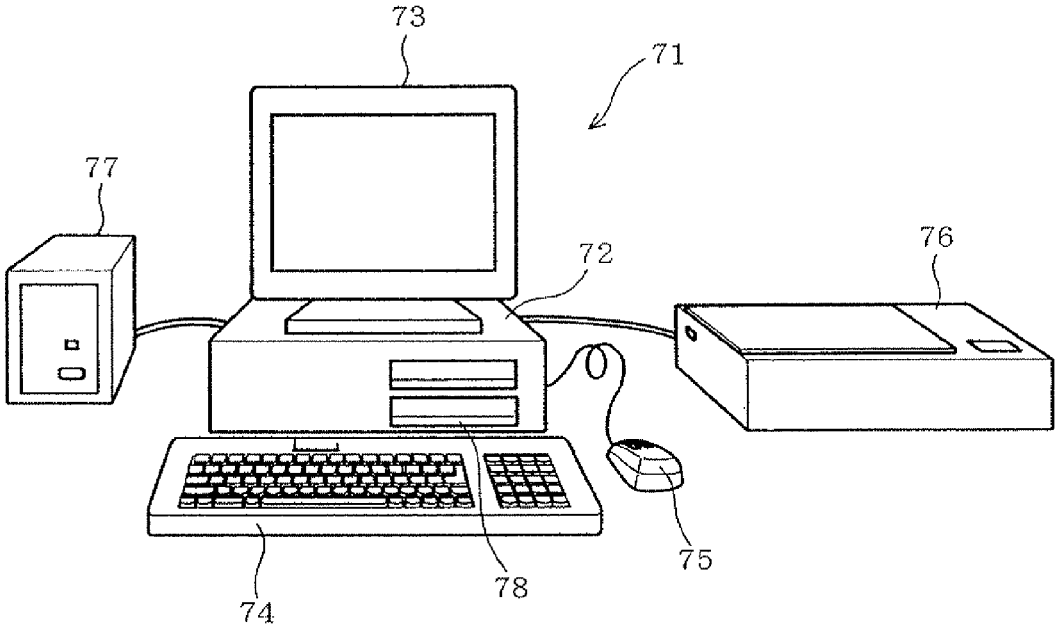
FIG. 20 is a perspective view showing an overall view of a punch data generating device according to a second exemplary embodiment.

FIG. 20 illustrates a second exemplary embodiment of the present disclosure and more particularly shows an overall view of punch data generating device 71. Punch data generating device 71 is configured in the form of a readily available system such as a personal computer system constituting a device independent of multi-needle embroidery sewing machine 1. The punch data generated by punch data generating device 71 is given to the multi-needle embroidery sewing machine 1. Punch data generating device 71 is configured by interconnection of generating device body 72, display 73 such as a color CRT (Cathode Ray Tube) display, keyboard 74, mouse 75, image scanner 76 capable of scanning color images, and external storage 77 such as a hard disc drive.

Generating device body 72 comprises a main body of a personal computer including components not shown in detail such as CPU, ROM, RAM, I/O interface, and optical disc drive 78 that reads data from and writes data into medium such as CD (Compact Disc) and DVD (Digital Versatile Disc), or more generally, optical disc. Punch data generating program may be pre-stored, for instance, into external storage 77, or may be stored in computer readable medium such as CD and DVD which is placed into optical disc drive 78 to be loaded for execution.

The punch data generating program, when executed, displays information on to display 73 such as images of patterns for which the punch data is generated and mandatory information for generating the punch data. By referring to the information shown on display 73, the user makes necessary inputs and issues instructions through key board 74 and mouse 75 operation. Further, image scanner 76 allows scanning of image data of original images of patterns for which punch data generation is intended. As an alternative to taking in scanned images by image scanner 76, the digitalized photograph images may be taken in which was captured by digital cameras, etc.

Through execution of the punch data generating program, generating device body 72 generates the punch data for executing the penetration forming operation using multi-needle embroidery sewing machine 1 based on image data of original images of patterns scanned by the user through image scanner 76. The second exemplary embodiment also allows generating device body 72 to function as both a draw data generator for generating the draw data and a cut data generator for generating the cut data. Thus, punch data can be generated for both drawing of predetermined patterns on workpiece W as well as cutting of workpiece W along the outline of the drawn pattern. In addition to such features, the present exemplary embodiment advantageously prevents tearing of workpiece W during pattern drawing while also eliminating uncut portions when cutting the outline of the pattern.

In each of the above described exemplary embodiments, the data modifying device is configured to modify both the draw data and the cut data generated as the punch data. In another exemplary embodiment, the data modifying device may be configured to modify only one of the draw data and the cut data. Yet, in another exemplary embodiment, only the draw data may be generated to serve as the punch data in which case the data modifying device may be configured to modify the draw data. Similarly, in another exemplary embodiment only the cut data may be generated to serve as the punch data in which case the data modifying device may be configured to modify the cut data. The above described exemplary embodiments were configured to determine the presence/absence of both the first and the second designated portions in modifying the draw data, however, the modification may be made by determining the presence/absence of only either one of the first and the second designated portions.

In each of the above described exemplary embodiments, punch data generating device has been configured to serve as control circuit 41 of multi-needle embroidery sewing machine 1 or was configured by a readily available personal computer. Alternatively, punch data generating device may be configured as a device that is connected directly or indirectly over a network with an embroiderable sewing machine or as a stand alone device for punch data generation.

In each of the above described exemplary embodiments, punch data generation was executed almost fully automatically by computer processing. However extraction of lines constituting the pattern or outline from the original image data, categorization of punch data type, and determining the sequence of penetration formation, etc. may be relied upon user input operation.

Still further, the embroiderable sewing machine may come in various configurations. For instance, the number of needle bars 8 provided in needle bar case 7 may be increased to 9 or 12. An embroidery sewing machine only provided with a single needle bar may be employed since penetrations can be formed by replacing the sewing needle with a punch needle. Various modifications are allowable throughout the configuration of multi-needle sewing machine 1, such as transfer mechanism 18, carriage 19, and holder 21 as long as they are true to the spirit of the present disclosure.

While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A punch data generating device that generates punch data for execution with an embroiderable sewing machine, the embroiderable sewing machine including a needle bar that is moved up and down and that is configured to allow attachment of a punch needle for forming a plurality of penetrations on a sheet of workpiece by piercing the workpiece in dot-by-dot strokes of the punch needle, and a transfer mechanism that is configured to transfer the workpiece in two predetermined directions in coordination with an up and down movement of the punch needle to execute a penetration forming operation for forming the penetrations on the workpiece, the punch data generating device, comprising:

a punch data generator that generates the punch data, the punch data including at least either of draw data being configured to instruct sequential formation of the penetrations to draw a predetermined pattern, and cut data being configured to instruct sequential formation of the penetrations at least along an outline of the predetermined pattern to allow cutting of the outline; and a data modifier that modifies at least either of the draw data and the cut data to change how the penetrations are to be formed.

2. The device according to claim 1, further comprising a determiner that determines presence/absence of a designated portion in the pattern, wherein when the determiner determines the presence of the designated portion, the data modifier modifies the draw data.

3. The device according to claim 2, wherein the designated portion includes:

a first portion that defines an acute angle being equal to or less than a predetermined angle when 3 adjacent punch dots within the draw data are connected by a straight line; and a second portion that define an intersection where a first line comprising adjacent punch dots within the draw data crosses or contacts a second line comprising adjacent punch dots within the cut data, and wherein when the determiner determines the presence of the designated portion, the data modifier deletes a part of the punch dots within the draw data that constitute the designated portion.

4. The device according to claim 1, wherein the data modifier modifies the cut data so that one or more punch dots are added to the cut data such that one or more penetrations formed at early stages and/or final stages of the penetration forming operation are punched through redundantly.

5. The device according to claim 2, wherein the data modifier modifies the cut data so that a punch dot is added to the cut data such that the penetration formed at early stages or final stages of the penetration forming operation is punched through redundantly.

6. The device according to claim 3, wherein the data modifier modifies the cut data so that at least one punch dot is added to the cut data such that one or more penetrations formed at early stages and/or final stages of the penetration forming operation are punched through redundantly.

7. The device according to claim 6, wherein the data modifier modifies the cut data so that a plurality of punch dots are added to the cut data such that the penetrations formed at the early stages and/or the final stages of the penetration forming operation are punched through redundantly.

8. The device according to claim 7, wherein the data, modifier modifies the cut data so that a plurality of punch dots are added Ad the cut data such that the penetrations formed at different locations at the early stages and/or the final stages of the penetration forming operation are punched through redundantly.

9. The device according to claim 8, wherein the data modifier modifies the cut data so that a plurality of punch dots are added to, the cut data such that the penetrations formed at different locations at the early stages and/or the final stages of the penetration forming operation are punched through twice.

10. The device according to claim 6, wherein the sewing machine further includes a motor that exerts the up and down movement of the needle bar, and wherein the data modifier modifies the cut data So that a plurality of punch dots are added to the cut data such that the penetrations formed at the early stages and/or the final stages of the penetration forming operation are punched through twice.

11. The device according to claim 4, wherein the data modifier modifies the cut data so that a punch dot is added to the cut data such that the penetration formed at the early stages or the final stages of the penetration forming operation is punched through twice.

12. A computer readable medium that stores a punch data generating program for generating punch data for execution with an embroiderable sewing machine, the embroiderable sewing machine including a needle bar that is moved up and down and that is configured to allow attachment of a punch needle for forming a plurality of penetrations on a sheet of workpiece by piercing the workpiece in dot-by-dot strokes of the punch needle, a transfer mechanism that is configured to transfer the workpiece in two predetermined directions in coordination with the up and down movement of the punch needle to execute a penetration forming operation for forming the penetrations on the workpiece, the punch data generating program, comprising:

instructions for generating the punch data, the punch data including at least either of draw data being configured to instruct sequential formation of the penetrations to draw a predetermined pattern, and cut data being configured to instruct sequential formation of the penetrations at least along an outline of the predetermined pattern to allow cutting of the outline; and instructions for modifying at least either of the draw data and the cut data to change how the penetrations are to be formed.

* * * * *